US009751336B2

(12) United States Patent
Ohnishi

(10) Patent No.: US 9,751,336 B2
(45) Date of Patent: Sep. 5, 2017

(54) PRINTING APPARATUS AND PRINTING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/109,448

(22) PCT Filed: Dec. 25, 2014

(86) PCT No.: PCT/JP2014/084441
§ 371 (c)(1),
(2) Date: Jul. 1, 2016

(87) PCT Pub. No.: WO2015/102087
PCT Pub. Date: Jul. 9, 2015

(65) Prior Publication Data

US 2016/0332459 A1 Nov. 17, 2016

(30) Foreign Application Priority Data

Jan. 6, 2014 (JP) ..... 2014-000143

(51) Int. Cl.
*B41J 11/00* (2006.01)
*B41J 2/21* (2006.01)
(Continued)

(52) U.S. Cl.
CPC ..... *B41J 11/002* (2013.01); *B41J 2/145* (2013.01); *B41J 2/2132* (2013.01); *B41J 25/001* (2013.01)

(58) Field of Classification Search
CPC ..... B41J 2/2132; B41J 2/145; B41J 11/0015; B41J 11/002; B41J 25/001
See application file for complete search history.

(56) References Cited

U.S. PATENT DOCUMENTS 7,374,280 B2 * 5/2008 Kusunoki ..... B41J 11/002 347/102
7,510,277 B2 * 3/2009 Konno ..... B41J 2/155 347/101
(Continued)

FOREIGN PATENT DOCUMENTS

| | | |
|---|---|---|
| CN | 103459156 | 12/2013 |
| JP | 2009202418 | 9/2009 |
| JP | 2012045908 | 3/2012 |

OTHER PUBLICATIONS

"International Search Report (Form PCT/ISA/210) of PCT/JP2014/084441", mailed on Mar. 17, 2015, with English translation thereof, pp. 1-4.
(Continued)

*Primary Examiner* — Anh T. N. Vo
(74) *Attorney, Agent, or Firm* — Jianq Chyun IP Office

(57) ABSTRACT

The disclosure appropriately performs high-quality printing in a case of using ultraviolet curing ink in a serial type inkjet printer. As a solution, a printing apparatus for performing printing in an inkjet mode by a multi-pass scheme includes: inkjet heads, a temporarily hardening light source, a fully hardening light source, and a controller configured to serve as a pixel selector, wherein the temporarily hardening light source radiates ultraviolet light whenever a predetermined number of main scan operations are performed, and the fully hardening light source radiates ultraviolet light after main scan operations of all printing passes finish.

11 Claims, 16 Drawing Sheets

(51) Int. Cl.
*B41J 2/145* (2006.01)
*B41J 25/00* (2006.01)

(56) References Cited

U.S. PATENT DOCUMENTS

| | | | | |
|---|---|---|---|---|
| 8,668,323 | B2 * | 3/2014 | Onishi | B41J 3/543 347/102 |
| 8,814,343 | B2 * | 8/2014 | Onishi | B41J 11/002 347/102 |
| 2009/0085999 | A1 * | 4/2009 | Furukawa | B05C 1/0813 347/102 |

OTHER PUBLICATIONS

"First Office Action of China Counterpart Application" with English translation thereof, issued on Dec. 30, 2016, p. 1-p. 14.

* cited by examiner

| | | | |
|---|---|---|---|
| A | | A | |
| | | | |
| A | | A | |
| | | | |

| | | | |
|---|---|---|---|
| A | B | A | |
| | B | | |
| A | | A | B |
| | | | B |

| | | | |
|---|---|---|---|
| A | B | A | |
| C | B | C | |
| A | | A | B |
| C | | C | B |

| | | | |
|---|---|---|---|
| A | B | A | D |
| C | B | C | D |
| A | D | A | B |
| C | D | C | B |

Example of mesh-dot type mixed dot arrangement

Example of 8pass of mixed dot arrangement

Example of 8pass of mixed dot arrangement

PRINTING APPARATUS AND PRINTING METHOD

CROSS-REFERENCE TO RELATED APPLICATION

This application is a 371 of international application of PCT application serial no. PCT/JP2014/084441, filed on Dec. 25, 2014, which claims the priority benefits of Japan application no. JP 2014-000143, filed on Jan. 6, 2014. The entirety of each of the above-mentioned patent applications is hereby incorporated by reference herein and made a part of this specification.

TECHNICAL FIELD

The disclosure relates to a printing apparatus and a printing method.

BACKGROUND ART

Inkjet printers for performing printing in an inkjet scheme according to the related art are being widely used. The inkjet printers eject ink drops from inkjet heads onto media, thereby forming ink dots on the media. These dots form individual pixels of print images. Also, as a configuration for an inkjet printer, a serial type configuration for controlling an inkjet head such that the inkjet head performs a main scan operation (a scanning operation) is being widely used. Also, as ink for inkjet printers, ultraviolet curing ink is being widely used.

CITATION LIST

Patent Literature

Patent Literature 1: JP-A-2012-45908

SUMMARY

Technical Problem

Recently, with demands for an improvement in print resolution and the like, the density of ink dots which are formed on media has increased. Also, with this, the distance between dots on medium has shortened, whereby dot contact (contact of dots) has become more likely to occur. However, for example, in a case where ink dots of different colors come into contact with each other, connection of the dots occurs, whereby the colors are mixed and bleeding (inter-color bleeding) occurs.

With respect to this, recently, printing in a multi-pass mode has been widely used as a printing method in inkjet printers. In the case of using a multi-pass mode, for example, it becomes possible to increase the distance between ink dots which are formed in one main scan operation. Also, in a case of using ultraviolet curing ink in an inkjet printer for performing printing in a multi-pass mode, generally, whenever the printer performs one main scan operation, the printer radiates ultraviolet light onto ink dots formed in the corresponding main scan operation, thereby hardening the dots. Therefore, according to this configuration, for example, it is possible to make contact of liquid ink dots unlikely to occur.

However, for example, in a case of performing printing in a setting of a high printing rate where the density of ink dots which are formed on media increases, it may be difficult to completely prevent contact of liquid ink dots only by performing printing in a multi-pass mode. Therefore, bleeding or the like attributable to contact of dots may occur, and the quality of printing may decrease.

Also, in a case of using ultraviolet curing ink in an inkjet printer for performing printing in a multi-pass mode, during the second and subsequent passes, around the landing positions of ink dots, hardened ink dots have been already formed. In this case, the hardened state means a state where ink dots have fully hardened due to irradiation with a sufficient amount of ultraviolet light. Therefore, in this case, the hardened dots generally repel liquid ink. The state where the hardened dots repel liquid ink specifically means the state where the hardened dots are unlikely to get wet with ink which is in a liquid state before a hardening process. Therefore, ink dots which are newly formed spread only in directions in which there are no hardened dots. As a result, the shapes of ink dots which are newly formed are influenced by the surrounding hardened dots.

For this reason, in a case of using ultraviolet curing ink in an inkjet printer for performing printing in a multi-pass mode, for example, dot shapes may become uneven, and the quality of printing may decrease. Also, more specifically, in some cases such as a case of performing printing in a state where a high printing rate has been set, protruding ink dots hardened in an area having a narrow width may continue in one direction, whereby so-called hardened streaks and the like may occur.

For this reason, it has been required to perform printing by a more appropriate method in inkjet printers using ultraviolet curing ink. It is therefore an object of the disclosure to provide a printing apparatus and a printing method capable of solving the above described problems.

Also, during prior art search, the applicant of this application found Patent Literature 1 disclosing a configuration seemingly similar to the disclosure. However, the configuration disclosed in Patent Literature 1 is not a serial type configuration but a configuration for a so-called line printer. In contrast with this, the configuration of the disclosure is for solving problems and the like specific to serial type inkjet printers as described above or will be described below, and is different from the configuration of Patent Literature 1 in configurations which are their conditions.

Solutions to Problem

In order to prevent occurrence of hardened streaks and so on, some methods such as a method of hardening ink dots at each position of a medium to a temporarily hardened state, without fully hardening the ink dots, by irradiation with weak ultraviolet light while printing is progressing can be considered. Also, in this case, irradiation with weak ultraviolet light is a convenient expression representing that irradiation with ultraviolet light is performed, for example, such that the total amount of ultraviolet light is smaller than the total amount of light required to fully harden ink dots. Therefore, other methods such as a method of performing irradiation with high-intensity ultraviolet light for a short time can also be considered. In this case, the intensity of irradiation with ultraviolet light means the amount of ultraviolet light which is used in irradiation for a predetermined unit time.

According to this configuration, for example, since there are no hardened dots while printing is progressing, it is possible to appropriately prevent the shapes of ink dots which are newly formed from being influenced by surrounding hardened dots. Therefore, it can be considered that it is possible to prevent occurrence of hardened streaks and so on. Further, since ink dots gradually flatten even after temporal hardening, it is possible to further uniformize the shapes of ink dots.

However, as described above, it is also necessary to sufficiently consider bleeding which is caused by contact of ink dots on media in inkjet printers. Further, even in the case of temporarily hardening ink dots as described above, if ink dots of different colors come into contact before irradiation with weak ultraviolet light, intercolor bleeding may occur and cause the quality of printing to decrease.

Here, with respect to such bleeding problem, it can be considered that, in serial type inkjet printers, it is only necessary to perform printing, for example, in a multi-pass mode, thereby increasing the distance between ink dots which are formed in one main scan operation. However, in a case where an inkjet printer having a normal configuration according to the related art performs printing with ultraviolet curing ink in a multi-pass mode, in order to appropriately prevent intercolor bleeding and so on, whenever the printer performs each main scan operation, the printer needs to irradiate ink dots formed by the corresponding main scan operation, with ultraviolet light. For this reason, for example, even in a case of temporarily hardening ink dots, whenever the printer performs each main scan operation, the printer needs to perform irradiation with weak ultraviolet light, thereby temporarily hardening ink dots.

However, in a case of performing printing in a multi-pass mode, a plurality of main scan operations corresponding to multiple printing passes is performed on each position on a medium. For this reason, in a case of temporarily hardening ink dots, irradiation with weak ultraviolet light is also performed as many times as the number of printing passes. Therefore, in this case, each ink dot on a medium is irradiated with ultraviolet light, and the number of times of irradiation thereof varies depending on what number the printing pass during which the corresponding ink dot is formed is.

Therefore, in this case, for example, between ink dots formed during the first printing pass and ink dots formed during the last printing pass, a difference in the degree of hardening of ink increases. For this reason, for example, in a case of using a configuration identical to or similar to an inkjet printer according to the related art, it is practically difficult to set the amount of weak ultraviolet light such that it is possible to appropriately harden all of ink dots formed during the first and last printing passes, to a temporarily hardened state.

More specifically, for example, in a case of using ink of a plurality of colors (for example, ink of colors of C, M, Y, and K) in an inkjet printer according to the related art, it is necessary to form ink dots of the individual colors in each main scan operation. Therefore, in a case of performing printing at high resolution having recently been required, in this configuration, the number of printing passes necessary to sufficiently prevent intercolor bleeding increases. For example, in case of a configuration in which ink dots are not formed at the positions of adjacent pixels in the same main scan operation in order to almost completely prevent intercolor bleeding, it is considered that about 24 to 36 passes are necessary. However, in this case, it is considered that a difference in the degree of hardening of ink between the first and last printing passes excessively increases. For this reason, in this configuration, it is practically difficult to appropriately harden all dots to a temporarily hardened state. Also, in this case, a decrease in printing speed attributable to the increase in the number of printing passes also becomes a problem.

As described above, in a case of using ultraviolet curing ink in a serial type inkjet printer, it may be impossible to appropriately perform high-quality printing only by using a configuration for temporarily hardening ink dots by irradiation with weak ultraviolet light. With respect to this, by more earnest researches, the inventor of this application thought of a method of reducing the number of colors of ink dots which are formed in a band area corresponding to each printing pass in each main scan operation by making the layout of inkjet heads for different colors different from general configurations according to the related art. More specifically, the inventor thought of a method of making the number of colors of ink dots, which are formed in a band area corresponding to each printing pass, smaller than N, for example, in a case of performing printing with ultraviolet curing ink of N-number of different colors (N is an integer of 2 or greater).

In this configuration, it becomes possible to suppress, for example, occurrence of intercolor bleeding, for example, by less printing passes. Also, in this case, since a difference in the degree of hardening of dots between the first and last printing passes decreases, it becomes possible to more appropriately perform temporal hardening on ink dots which are formed by each printing pass. Therefore, according to this configuration, it becomes possible to more appropriately perform, for example, high-quality printing.

Also, more specifically, by earnest research, the inventor of this application thought of a configuration having the following features (1) and (2), as a configuration for improving the quality of printing and implementing high resolution in a case of using ultraviolet curing ink in a serial type inkjet printer. That is, (1) the viscosity of ink dots formed by main scan operations is increased to a range in which bleeding does not occur, whereby temporal hardening is performed. In this case, for example, it is preferable to irradiate ink dots with ultraviolet light, for example, by UV LEDs, and minimize the intensity of ultraviolet light for irradiation within a range in which temporal hardening on ink dots is appropriately performed by ultraviolet light. Also, ultraviolet light for temporal hardening is radiated, for example, immediately after each main scan operation. Further, with respect to each area on a medium, after all main scan operations finish, the corresponding area is irradiated with intense ultraviolet light for completing hardening (fully hardening), for example, by radiating ultraviolet light by UV LEDs. (2) In a direction (a main scan direction) in which inkjet heads are moved during main scan operations, with respect to an arrangement of ink dots which are formed in the same main scan operation, the distance between dots is maximized and contact of dots is minimized. Especially, it is preferable to prevent liquid dots of different colors from coming into contact with each other. Also, more specifically, it can be considered a method of making contact of dots unlikely to occur, for example, by setting different reference positions for dots of the same color and dots of different colors. The inventor of this application found that if the conditions of (1) and (2) as described above are satisfied, it is possible to appropriately perform high-quality printing. The disclosure made by earnest research as described above has the following configurations.

(First Configuration)

A printing apparatus which performs printing on a medium with ultraviolet curing ink of N-number of different colors (N is an integer of 2 or greater) in an inkjet mode by a multi-pass mode for performing printing on each position on the medium by a plurality of printing passes includes: N-number of inkjet heads configured to eject ink drops of ultraviolet curing ink of the N-number of colors, respectively; a main scan driver configured to drive the N-number of inkjet heads to perform main scan operations of ejecting ink drops while moving in a predetermined main scan direction; a sub scan driver configured to relatively move the N-number of inkjet heads with respect to the medium in a sub scan direction perpendicular to the main scan direction; temporarily hardening light sources configured to radiate ultraviolet light which hardens ultraviolet curing ink on the medium to a temporarily hardened state which is a state where at least the surface of the ink has viscosity; a fully hardening light source configured to radiate ultraviolet light which completes hardening of the ultraviolet curing ink on the medium; and a pixel selector configured to select pixels onto which ink drops are ejected during each printing pass of the multi-pass mode, wherein the N-number of inkjet heads are installed such that the number of colors of ink dots which are formed in a band area corresponding to each printing pass in each main scan operation becomes smaller than N, and whenever a predetermined number of main scan operations are performed on each position on the medium, the temporarily hardening light sources radiate ultraviolet light which hardens ultraviolet curing ink to the temporarily hardened state, and after main scan operations of all printing passes on each position on the medium finish, the fully hardening light source radiates ultraviolet light.

In this configuration, it is possible to appropriately perform temporal hardening on ultraviolet curing ink on a medium, for example, by irradiating the ink with weak ultraviolet light by the temporarily hardening light sources. In this way, it is possible to make the ultraviolet curing ink, for example, a state where, even if the ink comes into contact with liquid ink of other colors, bleeding does not occur, and the ink does not repel the liquid ink of other colors. Therefore, according to this configuration, it is possible to appropriately prevent, for example, occurrence of intercolor bleeding, occurrence of hardened streaks, and so on. Also, it is possible to set the viscosity of ink in the temporarily hardened state to a degree of viscosity at which ink dots gradually flatten as time goes on, for example, by irradiating the ink dots with weak ultraviolet light by the temporarily hardening light sources. Further, in this case, it is possible to sufficiently flatten the ink dots by setting a time interval between when temporal hardening is performed and when ultraviolet light is radiated by the fully hardening light source. Therefore, according to this configuration, for example, it also is possible to perform high-gross printing by sufficiently flattening ink dots.

Also, since the inkjet heads are installed such that the number of colors of ink dots which are formed in a band area corresponding to each printing pass becomes smaller than N which is the number of all colors which are used in printing, with respect to ink dots of each color which are formed in a band area, it becomes easy to set an arrangement having a long distance between dots. Therefore, it is possible to make contact of liquid ink dots more unlikely to occur.

Further, in this case, it is possible to reduce the number of printing passes necessary to prevent, for example, intercolor bleeding and so on. Therefore, for example, with respect to the intensity of ultraviolet light which is radiated by the temporarily hardening light sources, even if it is considered that ultraviolet light is radiated a plurality of times by a plurality of printing passes, a settable range expands, whereby it becomes possible to appropriately set the intensity within a practical range. Therefore, according to this configuration, for example, in a case of using ultraviolet curing ink in a serial type inkjet printer, it is possible to more appropriately perform high-quality printing.

Also, in this configuration, the intensity of ultraviolet light which the temporarily hardening light sources radiate is made lower than the intensity of ultraviolet light which the fully hardening light source radiates. More specifically, it is preferable to set the intensity of ultraviolet light which the temporarily hardening light sources radiate, to 1/20 to 1/3 of the intensity of ultraviolet light which the fully hardening light source radiates. Also, it is more preferable to set the intensity of ultraviolet light which the temporarily hardening light sources radiate, to 1/10 to 1/3 of the intensity of ultraviolet light which the fully hardening light source radiates. According to this configuration, for example, it is possible to appropriately harden ink dots.

(Second Configuration)

In selection of pixels onto which ink drops are ejected during each printing pass, the pixel selector sets different spatial frequencies representing the intervals between pixels onto which ink drops are ejected during each printing pass, for a first printing pass and a second printing pass which are consecutively performed on the same area on the medium.

By more earnest research, the inventor of this application found that, for example, even in a case of using a configuration like the first configuration, there is still a case where unintended density irregularity or the like occurs in a print result and the quality of printing decreases. Also, the inventor found that the cause thereof is that a deviation in the positions of ink dots occurs between printing passes.

With respect to this problem, the inventor of this application further thought of a method of setting different spatial frequencies each of which represents the interval between pixels which are formed by a printing pass, for a plurality of printing passes which is consecutively performed on the same area on a medium, respectively. More specifically, the inventor thought of a method of setting different spatial frequencies each of which represents the interval between pixels which are formed by a printing pass, for example, for at least two printing passes which are consecutively performed on the same area on a medium.

Here, in a case where a deviation in the positions of ink dots occurs between printing passes, if spatial frequencies corresponding to the corresponding printing passes are the same, the same deviation occurs among all dots. Therefore, in this case, due to influence of the deviation in the positions of ink dots which occurs between the printing passes, it becomes easy for density irregularity to occur in a final print result image.

In contrast with this, in a case of setting different spatial frequencies for the individual printing passes, since the direction of the deviation in the positions of ink dots varies depending on the printing passes, it becomes difficult for the influence of the deviation in the positions of ink dots which occurs between printing passes to be noticeable. Also, as a result, even in a final print result image, it becomes difficult for unnecessary density irregularity to occur. Therefore, according to this configuration, for example, it becomes possible to more appropriately perform high-quality printing.

In other words, in addition to the above described features (1) and (2), the inventor of this application thought of a feature (3) that, with respect to a plurality of printing passes, different spatial frequencies are set for the individual printing passes. Also, in this case, since printing is performed in the multi-pass mode, (4) with respect to every printing pass (for example, k-number of passes), mask patterns are set such that individual addresses are not repeatedly printed with respect to masks designating pixels corresponding to ink dots which are formed during individual printing passes and printing is performed 100 percent by the sum of the k-number of passes.

According to this configuration, it is possible to appropriately prevent density irregularity from occurring in a final print result image, for example, due to influence of a deviation in the positions of ink dots. Therefore, it is possible to appropriately prevent, for example, interference and moiré from occurring. Also, with respect to spatial frequencies, it is preferable to maximize the differences, such that the frequency components are more widely distributed. Also, for example, even with respect to individual colors which are used in printing, it is preferable to set different spatial frequencies for ink dot arrangements.

Also, in this case, for example, by setting different spatial frequencies for the first printing pass and the second printing pass, it is possible to make density irregularity unlikely to occur in a final print result image. Further, by performing printing in the multi-pass mode, it is possible to appropriately set mask patterns such that printing of 100% is performed by main scan operations of all printing passes (for example, k-number of passes). Therefore, according to this configuration, for example, in a case of using ultraviolet curing ink in a serial type inkjet printer, it is possible to more appropriately perform high-quality printing.

(Third Configuration)

Printing is performed in the multi-pass mode such that ink drops of different colors are not ejected onto any of the same pixel and adjacent pixels in the main scan direction during the same printing pass. According to this configuration, for example, with respect to ink dots of different colors, it is possible to appropriately secure the distance between dots during the same pass. Also, as a result, it is possible to appropriately prevent connection of ink dots of different colors and occurrence of intercolor bleeding.

(Fourth Configuration)

The printing apparatus performs printing on the medium by a multi-pass mode in which the number of passes is k (k is an integer of 2 or greater), and in selection of pixels onto which ink drops are ejected during each printing pass, the pixel selector selects the pixels, such that, during printing passes more than half of the k-number of printing passes, ink drops of the same color are not ejected onto adjacent pixels in the main scan direction by the same printing pass.

According to this configuration, for example, at least in more than half of the printing passes, with respect to ink of the same color, it is possible to appropriately secure the distance between dots during the same pass. Also, as a result, it is possible to make connection of ink dots unlikely to occur. Therefore, according to this configuration, for example, it is possible to more appropriately uniformize the shapes of ink dots. Also, it is preferable that the pixel selector should select pixels with respect to every printing pass such that ink drops of the same color are not ejected onto adjacent pixels in the main scan direction during the same printing pass. According to this configuration, for example, it is possible to more appropriately uniformize the shapes of ink dots.

Also, since the contact angle of connected ink dots to a medium becomes large, it becomes easy for those ink dots to flatten in a shorter time. For this reason, if connection of ink dots occurs, it is easy for variation to occur even in the flatness of the ink dots and the like. In contrast with this, according to the above described configuration, for example, it is possible to more appropriately uniformize the degrees of flatness of ink dots.

(Fifth Configuration)

With respect to each position on the medium, the temporarily hardening light sources harden ink dots formed by ink drops ejected onto the medium in a main scan operation during each printing pass, to the temporarily hardened state, before a main scan operation corresponding to another printing pass is performed on the same position. According to this configuration, for example, with respect to ink dots which are formed by each main scan operation, it is possible to appropriately prevent connection with ink dots which are formed by the subsequent main scan operations, and so on.

(Sixth Configuration)

The N-number of inkjet heads include, at least, a first-color head that is an inkjet head configured to eject first-color ink drops which are ink drops of ultraviolet curing ink of a first color, and a second-color head that is an inkjet head configured to eject second-color ink drops which are ink drops of ultraviolet curing ink of a second color different from the first color, and the first-color head and the second-color head are installed such that their positions in the sub scan direction are deviated from each other, and with respect to each position on the medium, the first-color head ejects the first-color ink drops in one of the main scan operations which is determined according to the position on the medium, and after the first-color head ejects the first-color ink drops, in another main scan operation, the second-color head ejects the second-color ink drops, and with respect to each position on the medium, after the first-color head ejects the first-color ink drops, the temporarily hardening light sources harden the ultraviolet curing ink of the first color on the medium, to the temporarily hardened state, before the second-color head ejects the second-color ink drops, and the second-color head ejects the second-color ink drops onto the area where the ultraviolet curing ink of the first color has hardened to the temporarily hardened state.

According to this configuration, for example, it is possible to appropriately reduce the number of colors of ink dots which are formed in a band area of each printing pass. Therefore, according to this configuration, it is possible to more appropriately suppress occurrence of intercolor bleeding. Therefore, for example, it is possible to appropriately perform high-quality printing.

(Seventh Configuration)

The first-color head and the second-color head are installed side by side in the sub scan direction such that their positions in the sub scan direction do not overlap each other. According to this configuration, for example, it is possible to more appropriately reduce the number of colors of ink dots which are formed in each main scan operation. Therefore, according to this configuration, it is possible to more appropriately suppress occurrence of intercolor bleeding. Therefore, for example, it is possible to appropriately perform high-quality printing.

Also, with respect to the positions of the first-color head and the second-color head, a case where the positions in the sub scan direction do not overlap each other may be, for example, a case where the positions in the sub scan direction do not substantially overlap each other. The case where the positions in the sub scan direction do not substantially overlap each other may be, for example, a case where the positions of nozzle rows of the first-color head and the second-color head in the sub scan direction do not overlap each other.

(Eighth Configuration)

The N-number of inkjet heads further include a third-color head that is an inkjet head configured to eject third-color ink drops which are ink drops of ultraviolet curing ink of a third color different from both of the first color and the second color, and a fourth-color head that is an inkjet head configured to eject fourth-color ink drops which are ink drops of ultraviolet curing ink of a fourth color different from all of the first color, the second color, and the third color, and the third-color head is aligned in the sub scan direction, and is installed side by side with the first-color head in the main scan direction, and the fourth-color head is aligned in the sub scan direction, and is installed side by side with the second-color head, and with respect to each position on the medium, the first-color head and the third-color head eject the first-color ink drops and the third-color ink drops, respectively, in a main scan operation which is determined according to the position on the medium, and after the first-color head and the third-color head eject the first-color ink drops and the third-color ink drops, in another main scan operation, the second-color head and the fourth-color head eject the second-color ink drops and the fourth-color ink drops, respectively, and with respect to each position on the medium, after the first-color head and the third-color head eject the first-color ink drops and the third-color ink drops, the temporarily hardening light sources harden the ultraviolet curing ink of the first color and the ultraviolet curing ink of the third color on the medium, to the temporarily hardened state, before the second-color head and the fourth-color head eject the second-color ink drops and the fourth-color ink drops, and the second-color head and the fourth-color head eject the second-color ink drops and the fourth-color ink drops onto an area where the ultraviolet curing ink of the first color and the third color has hardened to the temporarily hardened state.

According to this configuration, for example, it is possible to appropriately reduce the number of colors of ink dots which are formed in a band area of each printing pass. Therefore, according to this configuration, it is possible to more appropriately suppress occurrence of intercolor bleeding. Therefore, for example, it is possible to appropriately perform high-quality printing.

Also, in this configuration, more specifically, for example, N-number of colors which are used in printing are divided into m-number of groups (m is an integer less than N) each of which includes one or more colors. Further, inkjet heads for ejecting ink drops of colors included in each group are installed such that their positions do not overlap inkjet heads for ejecting ink drops of colors included in the other groups, in the sub scan direction.

(Ninth Configuration)

The N-number of inkjet heads include at least a first-color head that is an inkjet head configured to eject first-color ink drops which are ink drops of ultraviolet curing ink of a first color, a second-color head that is an inkjet head configured to eject second-color ink drops which are ink drops of ultraviolet curing ink of a second color different from the first color, a third-color head that is an inkjet head configured to eject third-color ink drops which are ink drops of ultraviolet curing ink of a third color different from both of the first color and the second color, and a fourth-color head that is an inkjet head configured to eject fourth-color ink drops which are ink drops of ultraviolet curing ink of a fourth color different from all of the first color, the second color, and the third color, and the first-color head, the second-color head, the third-color head, and the fourth-color head are installed in this order, side by side in the main scan direction, such that their positions in the sub scan direction are sequentially deviated from each other by a distance which is the product of an integer and a pass width which is the width of one printing pass in the sub scan direction.

According to this configuration, for example, it is possible to appropriately reduce the number of colors of ink dots which are formed in a band area of each printing pass. Therefore, according to this configuration, it is possible to more appropriately suppress occurrence of intercolor bleeding. Therefore, for example, it is possible to appropriately perform high-quality printing.

(Tenth Configuration)

The N-number of inkjet heads include, at least, a first-color head that is an inkjet head configured to eject first-color ink drops which are ink drops of ultraviolet curing ink of a first color, and a second-color head that is an inkjet head configured to eject second-color ink drops which are ink drops of ultraviolet curing ink of a second color different from the first color, and in selection of pixels onto which ink drops are ejected during each printing pass, with respect to spatial frequencies representing the intervals between pixels onto which ink drops are ejected and which are included in the band area corresponding to one printing pass, the pixel selector sets the spatial frequency of pixels onto which ink drops are ejected by the first-color head and the spatial frequency of pixels onto which ink drops are ejected by the second-color head, such that they are different from each other.

According to this configuration, for example, it is possible to set different spatial frequencies of pixels which are formed in the same area on a medium during each printing pass, for individual colors of ink. Also, as a result, it is possible to appropriately implement a configuration in which density irregularity is more unlikely to occur, for example, in a final print result image.

Also, it is possible to set different spatial frequencies of pixels which are formed in the same band area on a medium during each printing pass, for all individual colors which are used in printing. According to this configuration, it is possible to more appropriately implement a configuration in which density irregularity is more unlikely to occur in a print result image.

(Eleventh Configuration)

Each of the first-color head and the second-color head has a plurality of nozzle rows, in each of which a plurality of nozzles is arranged in line in the sub scan direction. The plurality of nozzle rows is arranged side by side, for example, in the main scan direction. Also, in this case, it is preferable that each of the inkjet heads for all of the N-number of colors should have a plurality of nozzle rows.

In this configuration, for example, each of the inkjet heads of the individual colors can eject ink drops from the nozzles of the plurality of nozzle rows onto the same area on a medium in each main scan operation. Therefore, according to this configuration, for example, by one main scan operation, it is possible to perform printing identical or similar to printing by as many printing passes as the number of the nozzle rows.

(Twelfth Configuration)

A printing method of performing printing on a medium with ultraviolet curing ink of N-number of different colors (N is an integer of 2 or greater) in an inkjet mode by a multi-pass mode for performing printing on each position on the medium by a plurality of printing passes uses: N-number of inkjet heads configured to eject ink drops of ultraviolet curing ink of the N-number of colors, respectively; a main scan driver configured to drive the N-number of inkjet heads to perform main scan operations of ejecting ink drops while moving in a predetermined main scan direction; a sub scan driver configured to relatively move the N-number of inkjet heads with respect to the medium in a sub scan direction perpendicular to the main scan direction; temporarily hardening light sources configured to radiate ultraviolet light which hardens ultraviolet curing ink on the medium to a temporarily hardened state which is a state where at least the surface of the ink has viscosity; a fully hardening light source configured to radiate ultraviolet light which completes hardening of the ultraviolet curing ink on the medium; and a pixel selector configured to select pixels onto which ink drops are ejected during each printing pass of the multi-pass mode, wherein the N-number of inkjet heads are installed such that the number of colors of ink dots which are formed in a band area corresponding to each printing pass in each main scan operation becomes smaller than N, and whenever a predetermined number of main scan operations are performed on each position on the medium, the temporarily hardening light sources radiate ultraviolet light which hardens ultraviolet curing ink to the temporarily hardened state, and after main scan operations of all printing passes on each position on the medium finish, the fully hardening light source radiates ultraviolet light. According to this configuration, for example, it is possible to achieve the same effects as those of the first configuration.

(Thirteenth Configuration)

A printing apparatus which performs printing on a medium with ultraviolet curing ink of N-number of different colors (N is an integer of 2 or greater) in an inkjet mode by a multi-pass mode for performing printing on each position on the medium by a plurality of printing passes includes: N-number of inkjet heads configured to eject ink drops of ultraviolet curing ink of the N-number of colors, respectively; a main scan driver configured to drive the N-number of inkjet heads to perform main scan operations of ejecting ink drops while moving in a predetermined main scan direction; a sub scan driver configured to relatively move the N-number of inkjet heads with respect to the medium in a sub scan direction perpendicular to the main scan direction; temporarily hardening light sources configured to radiate ultraviolet light which hardens ultraviolet curing ink on the medium to a temporarily hardened state which is a state where at least the surface of the ink has viscosity; a fully hardening light source configured to radiate ultraviolet light which completes hardening of the ultraviolet curing ink on the medium; and a pixel selector configured to select pixels onto which ink drops are ejected during each printing pass of the multi-pass mode, wherein the N-number of inkjet heads include at least a first-color head that is an inkjet head configured to eject first-color ink drops which are ink drops of ultraviolet curing ink of a first color, and a second-color head that is an inkjet head configured to eject second-color ink drops which are ink drops of ultraviolet curing ink of a second color different from the first color, and whenever a predetermined number of main scan operations are performed on each position on the medium, the temporarily hardening light sources radiate ultraviolet light which hardens ultraviolet curing ink to the temporarily hardened state, and after main scan operations of all printing passes on each position on the medium finish, the fully hardening light source radiates ultraviolet light, and in selection of pixels onto which ink drops are ejected during each printing pass, with respect to spatial frequencies representing the intervals between pixels onto which ink drops are ejected and which are included in the band area corresponding to one printing pass, the pixel selector sets the spatial frequency of pixels onto which ink drops are ejected by the first-color head and the spatial frequency of pixels onto which ink drops are ejected by the second-color head, such that they are different from each other.

According to this configuration, for example, it is possible to set different spatial frequencies of pixels which are formed in the same area on a medium during each printing pass, for ink colors. Also, as a result, it is possible to appropriately implement a configuration in which density irregularity is more unlikely to occur, for example, in a final print result image. Therefore, according to this configuration, for example, in a case of using ultraviolet curing ink in a serial type inkjet printer, it is possible to appropriately perform high-quality printing.

Also, according to the quality of printing required, for example, with respect to N-number of inkjet heads, the inkjet heads may be installed, for example, such that the number of colors of dots which are formed in each band area becomes N like in the related art, without installing the inkjet heads such that the number of colors of ink dots which are formed in each band area becomes smaller than N. Even in this case, it is considered that it is possible to appropriately perform temporal hardening on ink dots, thereby appropriately performing printing. Further, even in this case, according to the thirteenth configuration, for example, by setting different spatial frequencies for individual passes and individual colors, it is possible to more appropriately implement a configuration in which density irregularity is more unlikely to occur in a print result image, for example, similarly in the second configuration and so on.

(Fourteenth Configuration)

A printing method of performing printing on a medium with ultraviolet curing ink of N-number of different colors (N is an integer of 2 or greater) in an inkjet mode by a multi-pass mode for performing printing on each position on the medium by a plurality of printing passes uses: N-number of inkjet heads configured to eject ink drops of ultraviolet curing ink of the N-number of colors, respectively; a main scan driver configured to drive the N-number of inkjet heads to perform main scan operations of ejecting ink drops while moving in a predetermined main scan direction; a sub scan driver configured to relatively move the N-number of inkjet heads with respect to the medium in a sub scan direction perpendicular to the main scan direction; temporarily hardening light sources configured to radiate ultraviolet light which hardens ultraviolet curing ink on the medium to a temporarily hardened state which is a state where at least the surface of the ink has viscosity; a fully hardening light source configured to radiate ultraviolet light which completes hardening of the ultraviolet curing ink on the medium; and a pixel selector configured to select pixels onto which ink drops are ejected during each printing pass of the multi-pass mode, wherein the N-number of inkjet heads include, at least, a first-color head that is an inkjet head configured to eject first-color ink drops which are ink drops of ultraviolet curing ink of a first color, and a second-color head that is an inkjet head configured to eject second-color ink drops which are ink drops of ultraviolet curing ink of a second color different from the first color, and whenever a predetermined number of main scan operations are performed on each position on the medium, the temporarily hardening light sources radiate ultraviolet light which hardens ultraviolet curing ink to the temporarily hardened state, and after main scan operations of all printing passes on each position on the medium finish, the fully hardening light source radiates ultraviolet light, and in selection of pixels onto which ink drops are ejected during each printing pass, with respect to spatial frequencies representing the intervals between pixels onto which ink drops are ejected and which are included in the band area corresponding to one printing pass, the pixel selector sets the spatial frequency of pixels onto which ink drops are ejected by the first-color head and the spatial frequency of pixels onto which ink drops are ejected by the second-color head, such that they are different from each other. According to this configuration, for example, it is possible to achieve the same effects as those of the thirteenth configuration.

Advantageous Effects of Invention

According to the disclosure, in a case of using ultraviolet curing ink in a serial type inkjet printer, it is possible to more appropriately perform high-quality printing.

BRIEF DESCRIPTION OF DRAWINGS

FIG. 1(*a*) and FIG. 1(*b*) are a front view and a top view illustrating an example of the configuration of a main portion of the printing apparatus 10.

FIG. 3(*a*) shows an example of a state in a case where the surrounding dots are in a liquid state. FIG. 3(*b*) shows an example of a state in a case where the surrounding dots have been already hardened to become a solid state. FIG. 3(*c*) shows an example of a state in a case where the surrounding dots are in a temporarily hardened state.

FIG. 5(*a*) shows an example of a state where a deviation in the positions of dots has not occurred. FIG. 5(*b*) shows an example of a state where a positional deviation of ½ of a pitch has occurred. FIG. 5(*c*) shows an example of a state where a positional deviation of one pitch has occurred.

FIG. 7(*a*) shows an example of the relation between areas of an inkjet head 202 corresponding to the individual printing passes, and spatial frequencies which are set. FIG. 7(*b*) to FIG. 7(*e*) show examples of a pattern of pixels which is selected in the each printing pass.

FIG. 12(*a*) shows a first modification of the configuration of the ink dot former 12. FIG. 12(*b*) shows a second modification of the configuration of the ink dot former 12.

FIG. 13(*a*) shows a third modification of the configuration of the ink dot former 12. FIG. 13(*b*) shows a fourth modification of the configuration of the ink dot former 12. FIG. 13(*c*) shows a fifth modification of the configuration of the ink dot former 12.

FIG. 14(*a*) shows a sixth modification of the configuration of the ink dot former 12. FIG. 14(*b*) shows a seventh modification of the configuration of the ink dot former 12.

FIG. 15(*a*) shows a first example of the configuration in which different spatial frequencies are set for the individual colors. FIG. 15(*b*) shows a second example of the configuration in which different spatial frequencies set for the individual colors.

FIG. 16(*a*) shows an example of the configuration of the inkjet head 202. FIG. 16(*b*) shows an example of a printing operation which is performed with the inkjet head 202.

DESCRIPTION OF EMBODIMENTS

Figure 1A:
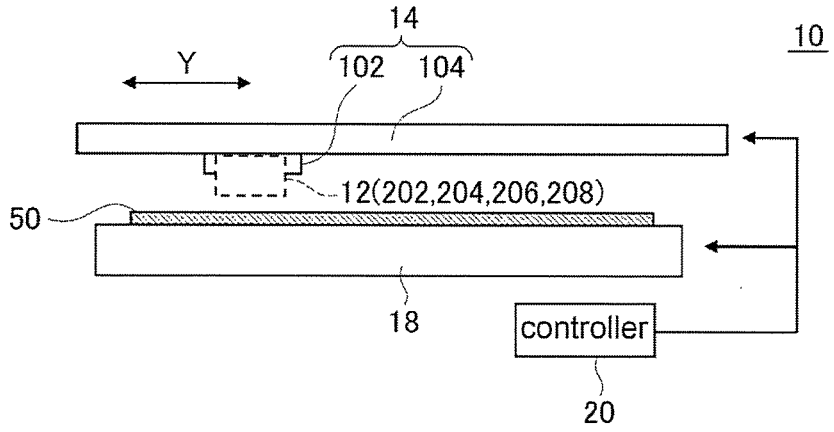
FIG. 1(*a*) and FIG. 1(*b*) are views illustrating an example of a printing apparatus 10 according to an embodiment of the disclosure.
Figure 1B:
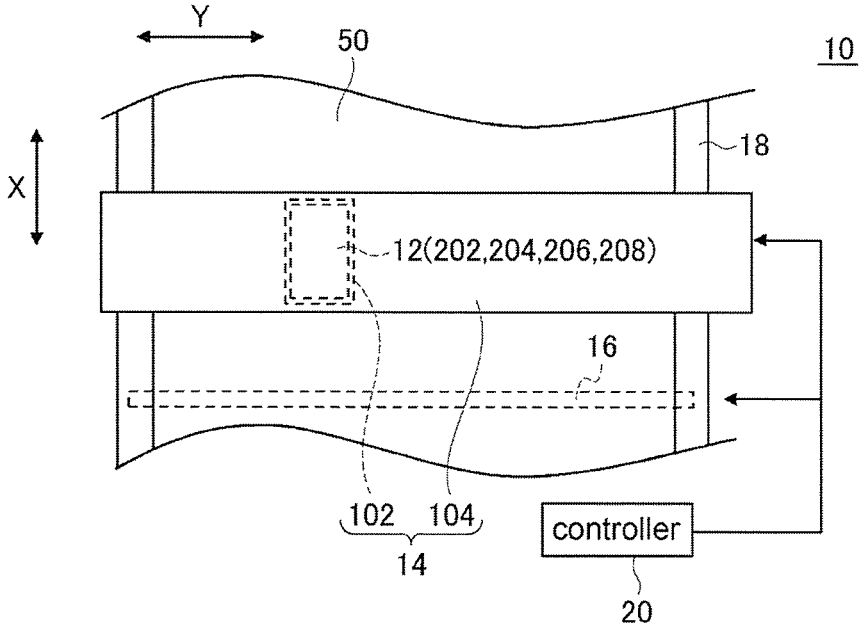

Hereinafter, embodiments according to the disclosure will be described with reference to the drawings. FIG. 1(*a*) and FIG. 1(*b*) show an example of a printing apparatus 10 according to an embodiment of the disclosure. FIG. 1(*a*) and FIG. 1(*b*) are a front view and a top view illustrating an example of the configuration of a main portion of the printing apparatus 10. Also, the printing apparatus 10 may have a configuration identical or similar to that of a known inkjet printer, except for points to be described below.

The printing apparatus 10 is an inkjet printer for performing printing in a serial mode in which an inkjet head performs main scan operations. Also, in the present embodiment, the printing apparatus 10 is an inkjet printer for performing printing in an inkjet mode, and performs printing on a medium 50 with ultraviolet curing ink of N-number of different colors (wherein N is an integer of 2 or greater) by a multi-pass mode for performing printing on each position on the medium 50 by a plurality of printing passes. Also, the printing apparatus 10 includes an ink dot former 12, a main scan driver 14, a sub scan driver 16, a platen 18, and a controller 20.

The ink dot former 12 is a part for performing printing on the medium 50 by forming ink dots corresponding to individual pixels of a print image on the medium 50. In the present embodiment, the ink dot former 12 includes inkjet heads 202, temporarily hardening light sources 204, temporarily hardening light sources 208, and a fully hardening light source 206.

The inkjet head 202 is a print head for ejecting ink drops of ultraviolet curing ink onto the medium 50. In the present embodiment, the ink dot former 12 has N-number of inkjet heads 202 corresponding to ultraviolet curing ink of N-number of colors for printing. Also, each of the inkjet heads 202 has, for example, nozzle rows in which nozzles for ejecting ink drops are arranged in line in a predetermined direction.

Also, in the present embodiment, the ultraviolet curing ink is, for example, ink which hardens by irradiation with ultraviolet light. The ultraviolet curing ink may be, for example, ink containing a monomer or an oligomer or the like together with a polymerization initiator which reacts to ultraviolet light. Also, the ultraviolet curing ink may further contain, for example, various known additives or the like. In the present embodiment, as the ultraviolet curing ink, for example, known ultraviolet curing ink can be suitably used. Also, it can be also considered to use ultraviolet curing ink containing an organic solvent or water, such as so-called solvent UV ink or water-based UV ink, as the ultraviolet curing ink of the present embodiment.

The temporarily hardening light source 204 and the temporarily hardening light source 208 are ultraviolet light source for radiating ultraviolet light for hardening ultraviolet curing ink on the medium 50 to a temporarily hardened state. The temporarily hardened state is, for example, a state where ink has hardened to a state where at least its surface has adhesion. The temporarily hardened state may be, for example, a state where hardening of ultraviolet curing ink has progressed to some extent. Also, more specifically, in the present embodiment, the temporarily hardened state is, for example, a state where ultraviolet curing ink does not repel liquid ink of different colors without occurrence of bleeding even if coming into contact with the liquid ink of different colors. The temporarily hardened state may be, for example, a state where viscosity has increased to 1000 mPa·sec to 500000 mPa·sec.

The fully hardening light source 206 is an ultraviolet light source for radiating ultraviolet light for completion of hardening (fully hardening) of ultraviolet curing ink on the medium 50. As the temporarily hardening light sources 204, the temporarily hardening light sources 208, and the fully hardening light source 206, for example, UVLED can be suitably used. According to the above described configuration, the ink dot former 12 forms ink dots on each medium 50. Also, a more specific configuration of the ink dot former 12 will be described in detail below.

The main scan driver 14 is a component for driving the inkjet heads 202 of the ink dot former 12 to perform main scan operations of ejecting ink drops while moving in a predetermined main scan direction (a Y direction in the drawings). In the present embodiment, the main scan driver 14 includes a carriage 102 and a guide rail 104. The carriage 102 holds the ink dot former 12 such that the nozzle rows of the inkjet heads 202 and the medium 50 face each other. Also, in the present embodiment, the carriage 102 holds the ink dot former 12 such that the nozzle rows extend in a sub scan direction (an X direction in the drawings) perpendicular to the main scan direction. The guide rail 104 is a rail for guiding movement of the carriage 102 in the main scan direction, and moves the carriage 102 in the main scan direction in response to an instruction of the controller 20.

The sub scan driver 16 is a component for driving the inkjet heads 202 of the ink dot former 12 to perform sub scan operations in which the inkjet heads relatively move in the sub scan direction with respect to the medium 50. In the present embodiment, the sub scan driver 16 is a roller for conveying each medium 50, and conveys the medium 50 during intervals between main scan operations, thereby making the inkjet heads 202 perform sub scan operations.

Further, for example, it can also be considered to use a configuration for performing sub scan operations by moving the inkjet heads 202 with respect to the medium 50 of which position is fixed without conveying the medium 50 (for example, an X-Y table type apparatus), as the configuration of the printing apparatus 10. In this case, as the sub scan driver 16, for example, a driver or the like for moving the inkjet heads 202 by moving the guide rail 104 in the sub scan direction can be used.

The platen 18 is a board-like member for mounting the medium 50, and supports the medium 50 such that the medium faces the nozzle surfaces of the inkjet heads 202 of the ink dot former 12 having the nozzles formed therein. Also, on the platen 18, for example, some components such as a heater for heating each medium 50 may be installed. According to this configuration, in some cases, such as a case where the ultraviolet curing ink contains a solvent, it is possible to quickly increase the viscosity of the ink by removing the solvent. Also, in this way, it is possible to further reduce the intensity of ultraviolet light necessary to semi-harden ultraviolet curing ink.

The controller 20 is, for example, a CPU of the printing apparatus 10, and controls the operation of each unit of the printing apparatus 10, for example, in response to instructions of a host PC. Also, in the present embodiment, the controller 20 has a function of a pixel selector for selecting pixels onto which ink drops are ejected during each printing pass in the multi-pass mode. The operation of the controller as the pixel selector will be described in more detail below. According to the above described configuration, the printing apparatus 10 performs printing on each medium 50.

Figure 2:
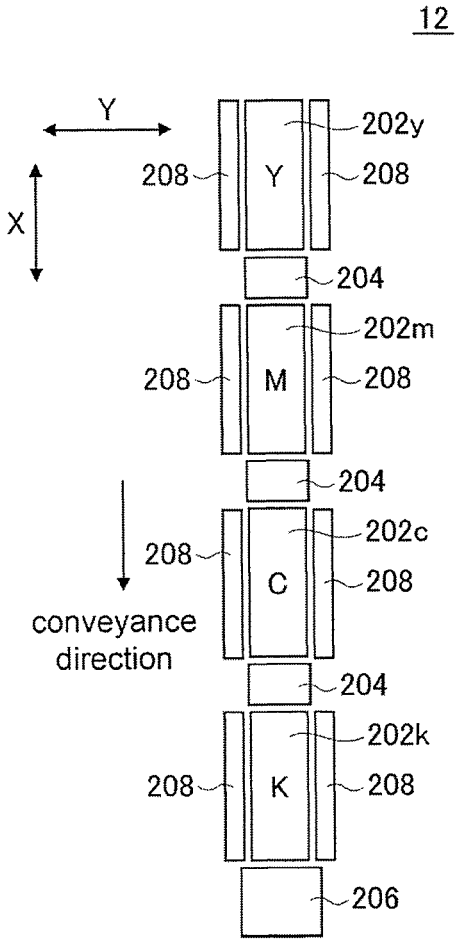
FIG. 2 is a view illustrating an example of a more specific configuration of an ink dot former 12.

Now, a more specific configuration of the ink dot former 12 will be described in detail. FIG. 2 shows an example of a more specific configuration of the ink dot former 12.

As described above, in the present embodiment, the ink dot former 12 has the N-number of inkjet heads 202 corresponding to the ultraviolet curing ink of N-number of colors. Also, more specifically, with respect to a case of using ultraviolet curing ink of individual colors of C, M, Y, and K in the printing apparatus 10 (see FIG. 1(*a*) and FIG. 1(*b*)), FIG. 2 shows a configuration in a case of having a plurality of inkjet heads 202*y*, 202*m*, 202*c*, and 202*k* (hereinafter, referred to as the inkjet heads 202*y* to 202*k*) for ejecting ink of the individual colors of C, M, Y, and K.

Also, in the configuration shown in FIG. 2, the Y (yellow) color is an example of a first color of the N-number of colors. The M (magenta) color is an example of a second color which is one of the N-number of colors and is different from the first color. Also, the inkjet head 202*y* is an example of a first-color head for ejecting first-color ink drops which are ink drops of ultraviolet curing ink of the first color. The inkjet head 202*m* is an example of a second-color head which is an inkjet head which is installed such that the position is deviated from the first-color head in the sub scan direction and ejects second-color ink drops which are ink drops of ultraviolet curing ink of the second color. Also, in a modification of the configuration of the printing apparatus 10, the ink dot former 12 may further include inkjet heads 202 for colors other than C, M, Y, and K. For example, the ink dot former 12 may further include inkjet heads 202 for W (white), CL (clear), and other specific colors.

Also, in the present embodiment, the inkjet heads 202*y* to 202*k* for ejecting ink drops of the individual different colors are installed such that their positions in the sub scan direction are deviated from each other. More specifically, in the configuration shown in FIG. 2, the inkjet heads 202*y* to 202*k* are installed side by side in the sub scan direction such that their positions in the sub scan direction do not overlap each other. In this way, the inkjet heads 202*y* to 202*k* are sequentially arranged side by side along a medium conveyance direction of a sub scan operation.

In this configuration, in each main scan operation, the inkjet heads 202*y* to 202*k* eject ink drops onto different areas of a medium, respectively. Also, onto the same area of a medium, the inkjet heads eject ink drops of the individual colors in different main scan operations which are performed alternately with sub scan operations. More specifically, for example, onto each position of a medium, the inkjet head 202*y* ejects ink drops of the Y color in a main scan operation which is determined according to the corresponding position on the medium. Also, after the inkjet head 202*y* ejects ink drops of the Y color onto an area, in another main scan operation, the inkjet head 202*m* ejects ink drops of the M color onto the area onto which the inkjet head 202*y* has ejected the ink drops of the Y color. Also, onto this area, the inkjet head 202*c* and the inkjet head 202*k* eject ink drops of the C color and the K color in subsequent different main scan operations. In this way, the inkjet heads 202*y* to 202*k* perform printing in a color-sequential mode in which the inkjet heads of the individual colors sequentially perform printing on each area of a medium.

Also, in the present embodiment, the ink dot former 12 includes the plurality of temporarily hardening light sources 208 and the plurality of temporarily hardening light sources 204. As shown in FIG. 2, the individual temporarily hardening light sources 208 are installed at positions adjacent to the plurality of inkjet heads 202*y* to 202*k* in the main scan direction, respectively. In this case, the individual temporarily hardening light sources 208 radiate low-intensity ultraviolet light which does not fully harden ink, onto ultraviolet curing ink ejected onto a medium in each main scan operation during the corresponding main scan operation. In this way, the temporarily hardening light sources 204 harden the ultraviolet curing ink on the medium to the temporarily hardened state.

More specifically, in each main scan operation, for example, temporarily hardening light sources 208 installed at positions adjacent to the inkjet head 202*y* radiate weak ultraviolet light onto ultraviolet curing ink of the Y color ejected onto a medium by the inkjet head 202*y*, thereby temporarily hardening the ink. Also, in a case of performing printing in a multi-pass mode as in the present embodiment, during each printing pass, the temporarily hardening light sources temporarily harden ink dots which are formed by the corresponding printing pass. Also, other temporarily hardening light sources 208 installed at positions adjacent to the inkjet head 202*m*, 202*c*, or 202*k* perform the same operation, thereby temporarily hardening ultraviolet curing ink of a corresponding color. In this way, with respect to each position on a medium, the individual temporarily hardening light sources 208 harden ink dots which are formed by ink drops ejected on the medium in a main scan operation during each printing pass, to the temporarily hardened state, before a main scan operation corresponding to another printing pass is performed on the same position. According to this configuration, for example, with respect to ink dots which are formed by each main scan operation, it is possible to appropriately prevent connection between ink dots which are formed by the subsequent main scan operations, and so on.

Also, in the present embodiment, the plurality of inkjet heads 202*y* to 202*k* perform main scan operations, for example, on both of a predetermined forward path and backward path in the main scan direction. Also, in association with this operation, the temporarily hardening light sources 208 are installed on both sides of each of the plurality of inkjet heads 202*y* to 202*k* in the main scan direction. Further, during a main scan operation, weak ultraviolet light is radiated by the temporarily hardening light sources 208 which are positioned on the rear side in the movement direction of the inkjet heads.

Also, the plurality of inkjet heads 202*y* to 202*k* may perform a main scan operation, for example, on only one of the forward path and the backward path in the main scan direction. In this case, the temporarily hardening light sources 208 may be installed only on one side of each of the plurality of inkjet heads 202*y* to 202*k* in the main scan direction.

The plurality of temporarily hardening light sources 204 is installed between the inkjet heads 202*y* to 202*k* in the sub scan direction. Therefore, the individual temporarily hardening light sources 204 further radiate low-intensity ultraviolet light which does not fully harden ink, onto ultraviolet curing ink ejected onto a medium by the inkjet heads installed on the upstream side from the temporarily hardening light sources 204 in the medium conveyance direction. In this way, the temporarily hardening light sources 204 further increase the viscosity of ultraviolet curing ink on a medium, and harden the ink to the temporarily hardened state in which the ink has such velocity that even if the ink comes into contact with ink of other colors, intercolor bleeding does not occur.

More specifically, for example, in case of a temporarily hardening light source 204 installed between the inkjet head 202*y* and the inkjet head 202*m*, after the inkjet head 202*y* ejects ink drops of the Y color onto each position on a medium, the ultraviolet curing ink of the Y color on the medium is hardened to the temporarily hardened state, before the inkjet head 202*m* ejects ink drops of the M color. Therefore, thereafter, the inkjet head 202*m* ejects ink drops of the M color onto the area where the ultraviolet curing ink of the Y color has hardened to the temporarily hardened state. Also, the other temporarily hardening light sources 204 installed at different positions radiate ultraviolet light at the same timing as described above in the operations of inkjet heads positioned on the upstream side and downstream side in the conveyance direction.

Also, in the present embodiment, the ink dot former 12 includes the fully hardening light source 206 on the downstream side from the inkjet heads 202*y* to 202*k* in the medium conveyance direction. Therefore, the fully hardening light source 206 radiates intense ultraviolet light for completing hardening of ultraviolet curing ink, onto each position on a medium, after main scan operations of all printing passes finish and ink drops of all the colors are ejected onto the corresponding position.

According to the present embodiment, printing is performed in the color-sequential mode, and ink is hardened to the temporarily hardened state, whereby it is possible to appropriately prevent, for example, ink dots of different colors from coming into contact with each other on a medium when the ink dots are in a liquid state having low viscosity and high fluidity. Therefore, it is possible to appropriately prevent intercolor bleeding or the like which is caused by ink of different colors being mixed.

Also, in the present embodiment, as described above, the fully hardening light source 206 radiates intense ultraviolet light for completing hardening of ultraviolet curing ink, after ink drops of all the colors are ejected. Therefore, it is possible to appropriately prevent liquid ink from being repelled by ink dots formed early, during printing using the inkjet heads 202$y$ to 202$k$. Therefore, it is possible to appropriately prevent hardened streaks on the like which is caused by, for example, protruding ink dots having hardened in an area having a narrow width continuing in one direction. Therefore, according to the present embodiment, it is possible to more appropriately perform printing, for example, in the color-sequential mode.

Also, it is possible to set the viscosity of ink in the temporarily hardened state to a degree of viscosity at which the ink dots gradually flatten as time goes on, for example, by irradiating the ink dots with weak ultraviolet light by the temporarily hardening light sources 204 and 208. Further, in this case, for example, it is possible to sufficiently flatten the ink dots by setting a time interval between when temporal hardening is performed and when irradiation with ultraviolet light is performed by the fully hardening light source 206. Therefore, according to the present embodiment, for example, it is possible to perform high-gross printing by sufficiently flattening ink dots.

As described above, in the present embodiment, printing is performed in the color-sequential mode, whereby a configuration in which ink dots of different colors are not connected is implemented. Therefore, occurrence of intercolor bleeding is appropriately prevented.

However, in a case of considering not only the intercolor bleeding problem but also, for example, uniformization of the shapes of ink dots, a configuration in which connection of even dots of the same ink is minimized is required. Therefore, for example, in a case where the number of printing passes is k (k is an integer of 2 or greater), during pixel selection of the controller 20 (see FIG. 1(*a*) and FIG. 1(*b*)), it is preferable to select pixels such that, in half or more of the k-number of printing passes, ink drops of the same color are not ejected onto adjacent pixels in the main scan direction by the same printing pass. According to this configuration, for example, at least in more than half of the printing passes, even with respect to ink of the same color, it is possible to appropriately set the distance between dots. Therefore, for example, it is possible to make connection of ink dots unlikely to occur, and more appropriately uniformize the shapes of ink dots.

Also, as described above, in the present embodiment, the ink dot former 12 uses two types of light sources (the temporarily hardening light sources 208 and temporarily hardening light sources 204) as ultraviolet light sources for temporarily hardening ink. Therefore, in this case, the viscosity of ultraviolet curing ink of each color after temporal hardening needs only to become sufficiently high viscosity, when the ink is irradiated with ultraviolet light by the temporarily hardening light sources 204.

Therefore, in this case, for example, with respect to the temporarily hardening light sources 208 which radiate ultraviolet light during each main scan operation, it is also possible to set the intensity of ultraviolet light to lower intensity as compared to a case where the temporarily hardening light sources 204 are not used. In this case, for example, even if as many main scan operation as the number of printing passes of the multi-pass mode are performed, whereby the same position on a medium is irradiated with ultraviolet light, a plurality of times, by the temporarily hardening light sources 208, it is possible to appropriately suppress the total amount of ultraviolet light. Therefore, it becomes possible to more easily and appropriately set the intensity of ultraviolet light which is radiated by the temporarily hardening light sources 208, within a practical range.

Also, it is considered to set the intensity of ultraviolet light which the temporarily hardening light sources 204 and 208 radiate, for example, to 1/20 to 1/3 of the intensity of ultraviolet light which the fully hardening light source 206 radiates. Also, it is more preferable to set the intensity of ultraviolet light which the temporarily hardening light sources 204 and 208 radiate, for example, to 1/10 to 1/4 of the intensity of ultraviolet light which the fully hardening light source 206 radiates. Also, it is preferable to set the intensity of ultraviolet light which is radiated by the temporarily hardening light sources 208 to be lower than the intensity of ultraviolet light which is radiated by the temporarily hardening light sources 204.

More specifically, with respect to the intensity of ultraviolet light which is radiated by each of the ultraviolet light sources, for example, it is preferable to set the ratio of the intensity "A" of ultraviolet light which is radiated by the temporarily hardening light sources 208, the intensity "B" of ultraviolet light which is radiated by the temporarily hardening light sources 204, and the intensity "C" of ultraviolet light which is radiated by the fully hardening light source 206, such that, for example, the relation of about 10~20:20~60:100 is satisfied. According to this configuration, for example, with respect to ultraviolet curing ink on a medium, it is possible to more appropriately perform temporal hardening and fully hardening.

Also, in the present embodiment, with respect to the viscosity of ink after temporal hardening which is performed by the temporarily hardening light sources 208, for example, it is possible to set to the viscosity at which flattening of ink dots easily processes as time goes on, for example, by sufficiently decreasing the intensity of ultraviolet light which is radiated by the temporarily hardening light sources 208. Further, in this case, for example, it is possible to appropriately and sufficiently set a time interval between when the viscosity is set and when ultraviolet light is radiated by the temporarily hardening light sources 204. Therefore, for example, it is also possible to harden ultraviolet curing ink to the temporarily hardened state by the temporarily hardening light sources 204 after waiting for ink dots which are formed by ink drops having landed on a medium to sufficiently flatten. In this case, it can be considered to make the temporarily hardening light sources 204 radiate ultraviolet light, for example, when several seconds to several tens seconds elapse after ink drops lands on the medium.

Therefore, according to the present embodiment, for example, it is possible to appropriately and sufficiently flatten ink drops. Therefore, for example, it is possible to more appropriately perform high-gross printing.

As described above, according to the present embodiment, for example, in a case of using ultraviolet curing ink in a serial type inkjet printer, it is possible to appropriately prevent problems such as intercolor bleeding and hardened streaks. Therefore, for example, it is possible to more appropriately perform high-quality printing.

Also, as described above, in the present embodiment, the printing apparatus 10 performs sub scan operations by conveying each medium. Further, in this case, as shown in some drawings, the medium conveyance direction becomes parallel with the sub scan direction. For this reason, in this case, with respect to the layout of the inkjet heads 202$y$ to 202$k$ and so on, it can be said that they are installed side by side in the conveyance direction of the medium 50. Also, in a modification of the configuration of the printing apparatus 10, for example, it can be also considered to perform sub scan operations by moving the inkjet heads 202$y$ to 202$k$. In this case, for example, it is preferable to install the inkjet heads 202$y$ to 202$k$, the temporarily hardening light sources 204, the fully hardening light source 206, and the like such that the direction of relative movement of each component to a medium becomes the same as that shown in FIG. 2.

Figures 3A, 3B, 3C:
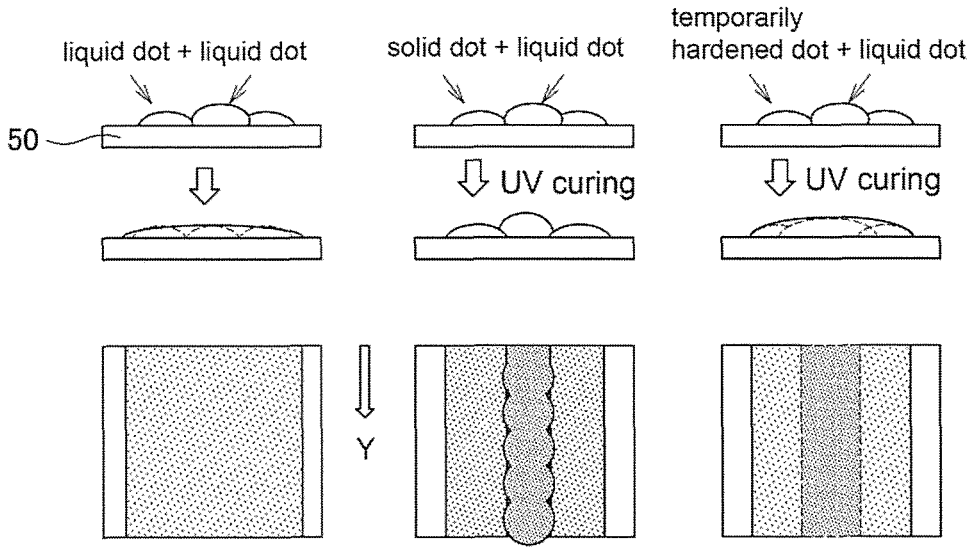
FIG. 3(*a*)~FIG. 3(*c*) are views illustrating examples of the relation between ink dots which are newly formed on a medium and the surrounding dots having been already formed, with respect to the state of hardening of ultraviolet curing ink.

Now, a state where ultraviolet curing ink hardens on a medium will be described in more detail. FIG. 3(*a*)~FIG. 3(*c*) are schematic views illustrating examples of the relation between ink dots which are newly formed on a medium and the surrounding dots having been already formed, with respect to the state of hardening of ultraviolet curing ink, and simply shows examples of cases where the surrounding dots are in a liquid, solid, or temporarily hardened state for explanation. FIG. 3(*a*) shows an example of a state in a case where the surrounding dots are in the liquid state. FIG. 3(*b*) shows an example of a state in a case where the surrounding dots have been already hardened to become the solid state. FIG. 3(*c*) shows an example of a state in a case where the surrounding dots are in the temporarily hardened state.

As shown in FIG. 3(*a*)~FIG. 3(*c*), the state of the ink dots which are newly formed on the medium is significantly different depending on the state of the surrounding dots already formed. For example, as shown in FIG. 3(*a*), in the case where the surrounding dots are in the liquid state, the ink dots which are newly formed are connected with the surrounding dots, thereby integrating with the surrounding dots. For this reason, for example, in a case where the surrounding dots are ink dots of different colors, intercolor bleeding occurs. Also, in this case, since the contact angle with the medium becomes large, the ink dots flatten in a short time.

Also, as shown in FIG. 3(*b*), in the case where the surrounding dots have already hardened to become the solid state, the ink of the ink dots which are newly formed are repelled by the surrounding dots. For this reason, in this case, it becomes easy for the ink dots which are newly formed to protrude due to a decrease in width. Also, as a result, in some cases such as a case of performing printing when a high printing rate has been set, it becomes easy for hardened streaks to occur.

In contrast with this, as shown in FIG. 3(*c*), in the case where the surrounding dots are in the temporarily hardened state, as described in association with FIGS. 1(*a*), 1(*b*) and 2 and the like, the surrounding dots become a state where they are not connected with other dots and do not repel liquid ink. For this reason, in this case, even if new dots are formed, bleeding and hardened streaks do not occur. Also, in this case, for example, with respect to the surrounding dots and the dots which are newly formed, it is possible to flatten the ink dots according to a degree of hardening to which the ink dots are temporarily hardened.

However, this preferable hardening state can be implemented only when the amount of irradiation with ultraviolet light is constant. For this reason, it is necessary to appropriately set the amount of irradiation with ultraviolet light which is performed by the temporarily hardening light sources 204 and the temporarily hardening light sources 208 (see FIG. 2), according to the properties of the used ultraviolet curing ink. Now, this point will be described in more detail.

Figure 4:
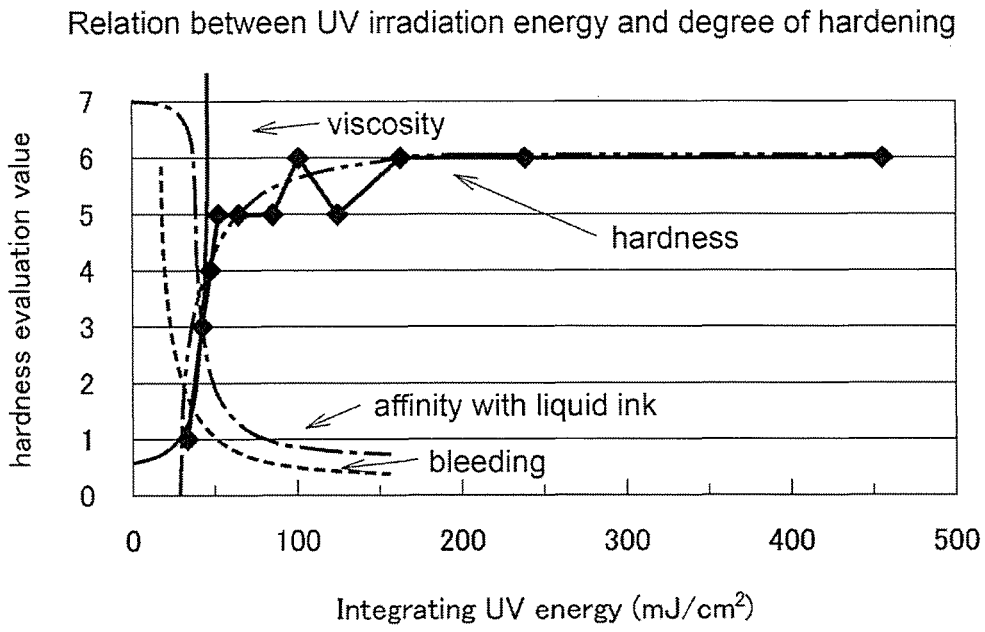
FIG. 4 is a graph illustrating an example of the relation between the amount of irradiation with ultraviolet light (the total amount of light) and the hardened state of ultraviolet curing ink.

FIG. 4 is a graph illustrating an example of the relation between the amount of irradiation with ultraviolet light (the total amount of light) and the hardened state of ultraviolet curing ink, and shows examples of the states of the viscosity of ink, the hardness of ink, easiness of occurrence of bleeding of ink, and the affinity of ink with liquid ink, with respect to the amount of irradiation with ultraviolet light. As shown by the graph, if the amount of irradiation with ultraviolet light (the total amount of light) increases, the viscosity of ink increases, and hardening progresses. Also, if the amount of irradiation with ultraviolet light increases, the easiness of bleeding of ink decreases. Meanwhile, the affinity with liquid ink decreases if the amount of irradiation with ultraviolet light increases.

Also, all of these individual properties vary steeply after the amount of irradiation with ultraviolet light reaches a certain amount, as shown by the graph. Further, in order to harden ultraviolet curing ink to the temporarily hardened state desirable as described above, generally, it becomes necessary to set the amount of irradiation with ultraviolet light within a range in which those individual properties vary steeply.

In the present embodiment, as described in association with FIG. 2 and the like, with respect to the ultraviolet curing ink of the plurality of colors, printing is performed in the color-sequential mode. In contrast with this, in inkjet printers according to the related art, a configuration in which inkjet heads for different colors are installed in line in a main scan direction and ink drops of all the colors are ejected in each main scan operation is being widely used. Further, in this case, since ink dots of the individual colors are formed by the same main scan operation, it can be said that an intercolor bleeding problem is likely to occur. For this reason, in this case, in order to appropriately set the amount of irradiation with ultraviolet light for hardening to the temporarily hardened state, it is necessary to sufficiently consider, for example, the easiness of occurrence of bleeding and so on as shown by the graph of FIG. 4.

Also, in the case of the configuration in which ink dots of individual colors are formed by the same main scan operation, in order to prevent intercolor bleeding, it is considered that, at least, it is necessary to perform printing in a multi-pass mode, and perform irradiation with ultraviolet light whenever each main scan operation is performed. Also, in this case, irradiation of each position on a medium with ultraviolet light is performed at least as many times as the number of printing passes. Therefore, in this case, each ink dot on a medium is irradiated with ultraviolet light, the number of times of irradiation thereof varies depending on what number the printing pass during which the corresponding ink dot is formed is. As a result, in this case, for example, between ink dots formed during the first printing pass and ink dots formed during the last printing pass, a difference in the degree of hardening of dot is generated.

Also, in case of the configuration according to the related art as described above, in order to appropriately prevent intercolor bleeding, it becomes necessary to sufficiently increase the number of printing passes. Further, in this case, with the increase in the number of passes, the printing time may significantly increase. Also, in this case, it is considered that a difference in the degree of hardening of dots between the first and last printing passes excessively increases. Further, in this case, it is not easy to appropriately perform temporal hardening on ink dots during all of the first to last printing passes.

In contrast with this, in the present embodiment, as described above, printing is performed by the color-sequential mode. For this reason, in each main scan operation, intercolor bleeding does not occur. Therefore, it is possible to sufficiently decrease the intensity of irradiation with ultraviolet light in a case of radiating ultraviolet light whenever each main scan operation is performed. For this reason, according to the present embodiment, for example, it becomes possible to more easily and appropriately set the intensity of ultraviolet light which is radiated by the temporarily hardening light sources 204 and the like in order to temporarily harden ink dots, within a practical range. Therefore, for example, it is possible to more appropriately perform high-quality printing.

Also, as described above, in the present embodiment, the printing apparatus 10 (see FIG. 1(*a*) and FIG. 1(*b*)) performs printing in a multi-pass mode. In this case, it is preferable to perform printing in the multi-pass mode such that ink drops are not ejected onto adjacent pixels in the main scan direction during the same printing pass. According to this configuration, for example, it is possible to more appropriately prevent liquid ink dots from coming into contact with each other. In this case, contact of liquid ink dots is, for example, contact of dots of ink having landed on a medium. Therefore, it is possible to prevent connection of ink dots and the like, and more appropriately uniformize the shapes of ink dots.

In this case, since the contact angle of connected ink dots to a medium becomes large, it becomes easy for those ink dots to flatten in a shorter time. For this reason, if connection of ink dots occurs, it is easy for variation to occur even in the flatness of the ink dots and the like. In contrast with this, according to the above described configuration, for example, it is possible to more appropriately uniformize the degrees of flatness of ink dots.

As described above, according to the present embodiment, for example, by combining printing in the color-sequential mode and temporal hardening of ultraviolet curing ink, it becomes possible to perform high-quality printing. However, in order to more appropriately perform high-quality printing in an inkjet printer, it is required to sufficiently consider even a deviation in the positions of ink dots which are formed on a medium. Now, this point will be described in detail.

Figure 5A:
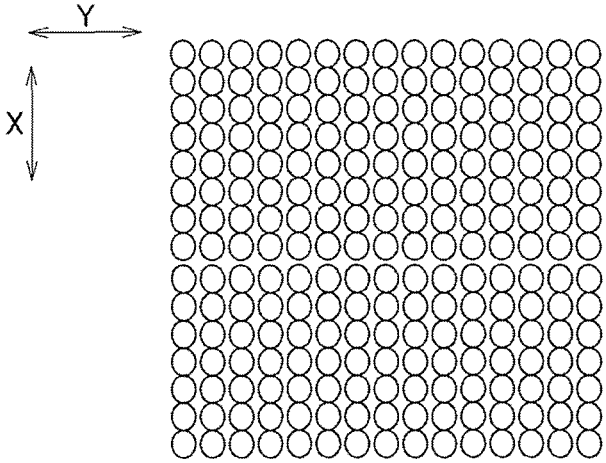
FIG. 5(*a*)~FIG. 5(*c*) are views for explaining influence of a deviation in the positions of dots.
Figure 5B:
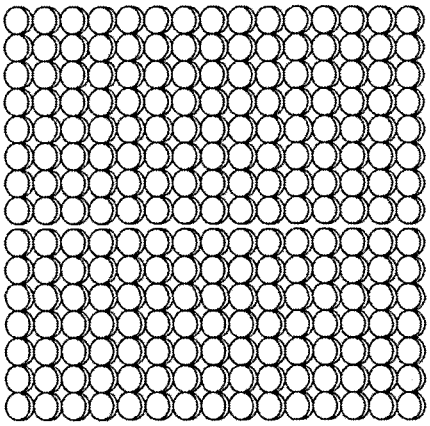
Figure 5C:
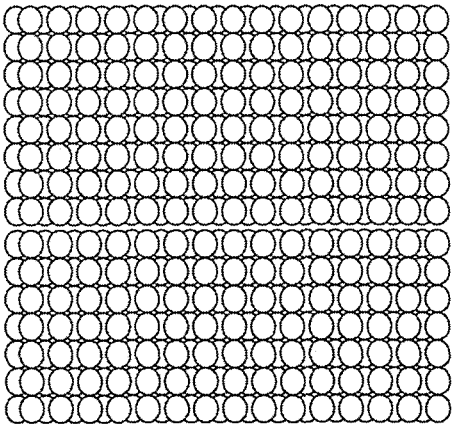

FIG. 5(*a*)~FIG. 5(*c*) are views for explaining influence of a deviation in the positions of ink dots. FIG. 5(*a*) shows an example of a state where a deviation in the positions of ink dots has not occurred. In this case, ink dots are arranged at regular intervals (pitch) which are determined according to print resolution.

In contrast with this, in an inkjet printer, for example, due to an error in the feed amount by which a medium is conveyed, or the like, a deviation in landing positions of ink drops may occur. Also, as a result, positions of ink dots which are formed on the medium may be deviated. Further, in a configuration in which printing is performed in a multi-pass mode like in the present embodiment, if such a deviation occurs, due to influence of the deviation in the positions of ink dots occurring between printing passes, it becomes easy for density irregularity to occur in a final print result image.

FIG. 5(*b*) and FIG. 5(*c*) show examples of a state where a deviation in the positions of ink dots has occurred. FIG. 5(*b*) shows an example of a state where a positional deviation of ½ of a pitch has occurred. FIG. 5(*c*) shows an example of a state where a positional deviation of one pitch has occurred. In this case where a positional deviation has occurred as shown in FIG. 5(*b*) or FIG. 5(*c*), after printing, the state varies, as compared to the normal state shown in FIG. 5(*a*).

Also, by more earnest research, the inventor of this application focused on the relation between influence of a positional deviation and a spatial frequency representing an interval between pixels onto which ink drops are ejected during each printing pass. Then, the inventor found that, in a case where a deviation in the positions of ink dots occurs between printing passes, if spatial frequencies corresponding to the individual printing passes are the same, all dots are likely to be deviated by the same amount, resulting in an unintended density irregularity. Also, the inventor found that, for example, with respect to a case where the dot size is larger than the pitch corresponding to resolution, in a case where the spatial frequency components of dot patterns which are formed by individual printing passes are the same, due to slight deviation in the positions of ink dots, significant change in the density occurs.

Figure 6:
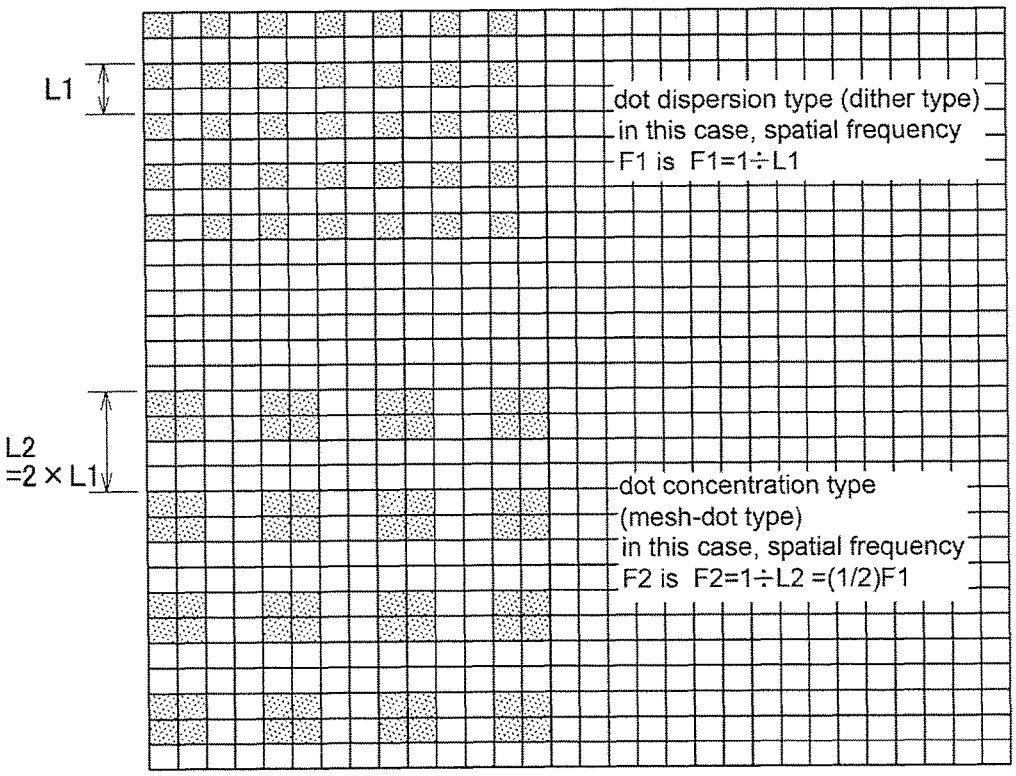
FIG. 6 is a view illustrating an example of a dot arrangement with respect to ink dots which are formed on a medium.

Now, the spatial frequencies of dot patterns which are formed by individual printing passes will be described. FIG. 6 shows an example of a dot arrangement with respect to ink dots to be formed on a medium.

In a case of performing printing in a multi-pass mode, during each printing pass, the printing apparatus 10 (see FIG. 1(*a*) and FIG. 1(*b*)) selects some pixels from all pixels in a band area corresponding to the corresponding printing pass, and forms ink dots at the positions of the selected pixels. Therefore, ink dots which are formed by each printing pass are discretely arranged at the positions of some pixels in a band area on a medium. In this case, a band area corresponding to a printing pass is, for example, an area on a medium which is a printing target by the corresponding printing pass.

Also, an arrangement of ink dots which are formed by each printing pass is determined according to setting of a mask designating pixels corresponding to ink dots which are formed by the corresponding printing pass. Therefore, ink dots which are formed by each printing pass are arranged on a medium by disposing a certain pattern which is determined according to setting of a mask. Also, as a result, ink dots which are formed by each printing pass are arranged on the medium in the pattern of a spatial frequency corresponding to the corresponding printing pass, according to setting of a mask. In this case, a spatial frequency corresponding to a printing pass is, for example, a spatial frequency representing an interval between pixels onto which ink drops are ejected during the corresponding printing pass. Also, a spatial frequency corresponding to a printing pass may be, for example, a spatial frequency which is the maximum value (the peak value) obtained by converting the interval distribution of ink drops which are formed by the corresponding printing pass into a spatial frequency distribution.

More specifically, for example, in a case of ink dots in a pattern shown as a dot dispersion type (a dither type) on the upper side of FIG. 6 during a printing pass, a spatial frequency F1 corresponding to the corresponding printing pass becomes 1/L1. In this case, L1 is the interval between ink dots which are formed in this pattern.

Also, in a case of ink dots in a pattern shown as a dot concentration type (a mesh-dot type) on the lower side of FIG. 6, a spatial frequency F2 corresponding to the corresponding printing pass becomes 1/L2. In this case, L2 is the interval between ink dots which are formed in this pattern.

Also, in these examples, the spatial frequency F2 in case of the dot concentration type is half of the spatial frequency F1 in case of the dot dispersion type. Therefore, it can be seen from these examples that the spatial frequency varies depending on the dot forming method.

For this reason, the inventor of this application thought of a method of setting different spatial frequencies each of which represents the interval between pixels which are formed by a corresponding printing pass, for a plurality of printing passes which is consecutively performed on the same area on a medium, respectively, as a method for preventing change in density described with reference to FIG. 5(*a*)~FIG. 5(*c*) and so on. More specifically, the inventor thought of a method of setting different spatial frequencies each of which represents the interval between pixels which are formed by a corresponding printing pass, for example, for at least two printing passes which are consecutively performed on the same area on a medium.

Figures 7A, 7B, 7C, 7D, 7E:
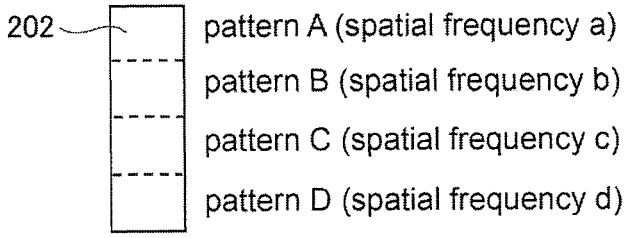
FIG. 7(*a*)~FIG. 7(*e*) are views illustrating an example of a configuration in which different spatial frequencies are set for printing passes, respectively.

FIG. 7(*a*)~FIG. 7(*e*) show an example of a configuration in which different spatial frequencies are set for printing passes, respectively. FIG. 7(*a*) shows an example of the relation between areas of an inkjet head 202 corresponding to the individual printing passes, and spatial frequencies which are set.

Also, the inkjet head 202 shown in FIG. 7(*a*) is, for example, an inkjet head corresponding to each of the inkjet heads 202*y* to 202*k* shown in FIG. 2. Also, in FIG. 7(*a*)~FIG. 7(*e*) for simple explanation, the number of printing passes is set to 4. The number of printing passes may be a number other than 4.

As described in association with FIG. 1(*a*)~FIG. 1(*b*) and so on, in the present embodiment, the controller 20 (see FIG. 1(*a*)~FIG. 1(*b*)) has a function of a pixel selector for selecting pixels onto which ink drops are ejected during each printing pass in the multi-pass mode. More specifically, the controller 20 selects pixels onto which ink drops are ejected during each printing pass, for example, according to a mask pattern preset for the corresponding printing pass.

For example, in the case shown in FIG. 7(*a*)~FIG. 7(*e*), the controller 20 selects pixels on the basis of the mask having a preset pattern "A" for the first printing pass. In this case, the spatial frequency of the pattern "A" is set to a predetermined spatial frequency "a". Also, during each of the second to fourth printing passes, the controller selects pixels on the basis of a mask of a corresponding one of preset patterns "B" to "D". In this case, the spatial frequencies of the patterns "B" to "D" are set to predetermined spatial frequencies "b" to "d", respectively.

FIG. 7(*b*) to FIG. 7(*e*) show examples of patterns of pixels which are selected during the individual printing passes. In the present embodiment, during the first printing pass, the controller 20 selects pixels, for example, in a pattern in which four pixels with letter "A" written therein are selected from sixteen pixels as shown in FIG. 7(*b*). In this case, selecting pixels in the pattern is referred to as selecting pixels by repeating the pattern with respect to individual pixels included in a band area, for example.

Also, during the second printing pass, the controller 20 selects pixels, for example, in a pattern in which four pixels with letter "B" written therein are selected from sixteen pixels as shown in FIG. 7(*c*). During the third printing pass, the controller 20 selects pixels, for example, in a pattern in which four pixels with letter "C" written therein are selected from sixteen pixels as shown in FIG. 7(*d*). Also, during the fourth printing pass, the controller 20 selects pixels, for example, in a pattern in which four pixels with letter "D" written therein are selected from sixteen pixels as shown in FIG. 7(*e*).

If pixels are selected as described above, it is possible to appropriately set mask patterns, for example, such that printing of 100% is performed by four main scan operations corresponding to the total number of printing passes. In this case, it is possible to appropriately perform printing in a multi-pass mode.

Also, in a case of selecting pixels as described above, for example, with respect to printing passes which are consecutively performed on the same area on a medium, it is possible to appropriately set different spatial frequencies corresponding to the individual printing passes, respectively. Also, as a result, it is also possible to make density irregularity unlikely to occur, for example, in a print result image. Therefore, according to the present embodiment, for example, in a case of using ultraviolet curing ink in a serial type inkjet printer, it is possible to more appropriately perform high-quality printing.

Also, in the example shown in FIG. 7(*a*)~FIG. 7(*e*), for simple explanation, a case where the spatial frequency of the pattern "A" and the spatial frequency of the pattern "C" are the same and the spatial frequency of the pattern "B" and the spatial frequency of the pattern "D" are the same is shown as an example. Even in this case, by using a plurality of types of patterns having different spatial frequencies, it is possible to appropriately prevent density irregularity from occurring in a print result image. Also, with respect to spatial frequencies corresponding to individual printing passes, it is more preferable that the spatial frequencies of all printing passes should be different from one another. According to this configuration, for example, it is possible to more appropriately prevent occurrence of density irregularity.

Also, as described with reference to FIG. 5(*a*)~FIG. 5(*c*) and so on, density irregularity which occurs when a multi-pass mode is performed occurs, for example, due to an error in the feed amount by which a medium is conveyed, or the like. Therefore, in order to appropriately prevent such density irregularity, for example, with respect to the spatial frequencies corresponding to the individual printing passes, it is considered that it is important to set different spatial frequencies of the sub scan direction for the individual printing passes, respectively. In other words, in the case of setting different spatial frequencies corresponding to the individual printing passes, it is also considered that it is especially preferable to set different spatial frequencies with respect to the sub scan direction.

Now, setting of pixels to be selected during each printing process will be described in more detail. FIGS. 8 to 11 show examples of selection of pixels which are formed with respect to ink of one color by individual printing passes in a case of performing printing in a multi-pass mode.

Also, the examples to be described with reference to FIGS. 8 to 11 are more specific examples of a method of selecting pixels to be formed by individual printing passes in a configuration in which different spatial frequencies are set for the individual printing passes, respectively. Also, patterns shown in FIGS. 8 to 11 are, for example, patterns of pixels to be formed by the individual printing passes by the individual inkjet heads 202*y* to 202*k* shown in FIG. 2. Also, in FIGS. 8 to 11, for convenience of illustration, cells representing pixels to be formed by the individual printing passes are filled with different patterns.

Figure 8:
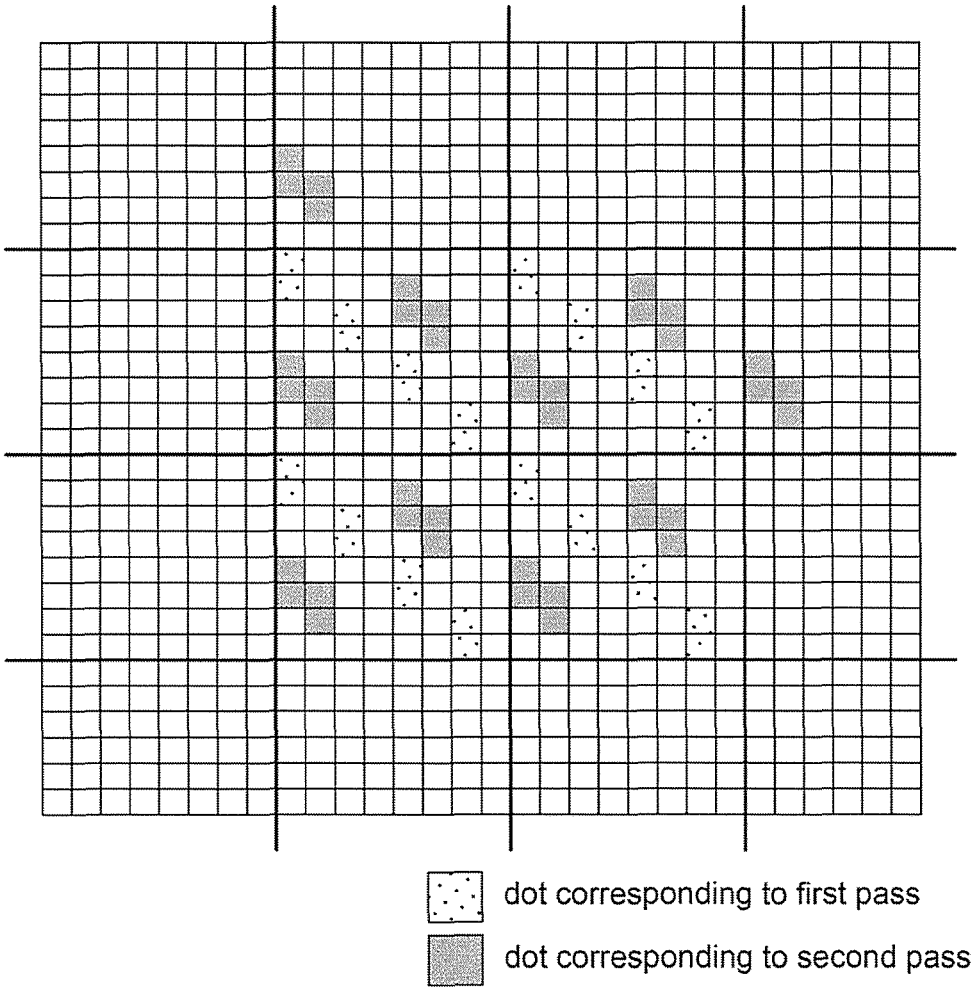
FIG. 8 is a view illustrating an example of the configuration in which different spatial frequencies are set for printing passes, respectively.

FIG. 8 is a view illustrating an example of the configuration in which different spatial frequencies are set for printing passes, respectively, and shows, as an example, a case of selecting pixels by a mesh-dot type mixed dot arrangement which is dot arrangement in which there are mesh-dot type arrangements together. Also, in FIG. 8, in order to facilitate understanding of a method of selecting pixels relative to two printing passes, only with respect to the earliest two printing passes, there are shown pixels to be selected. In the subsequent printing passes, for example, pixels other than the pixels selected by the earliest two printing passes may be appropriately selected.

Figure 9:
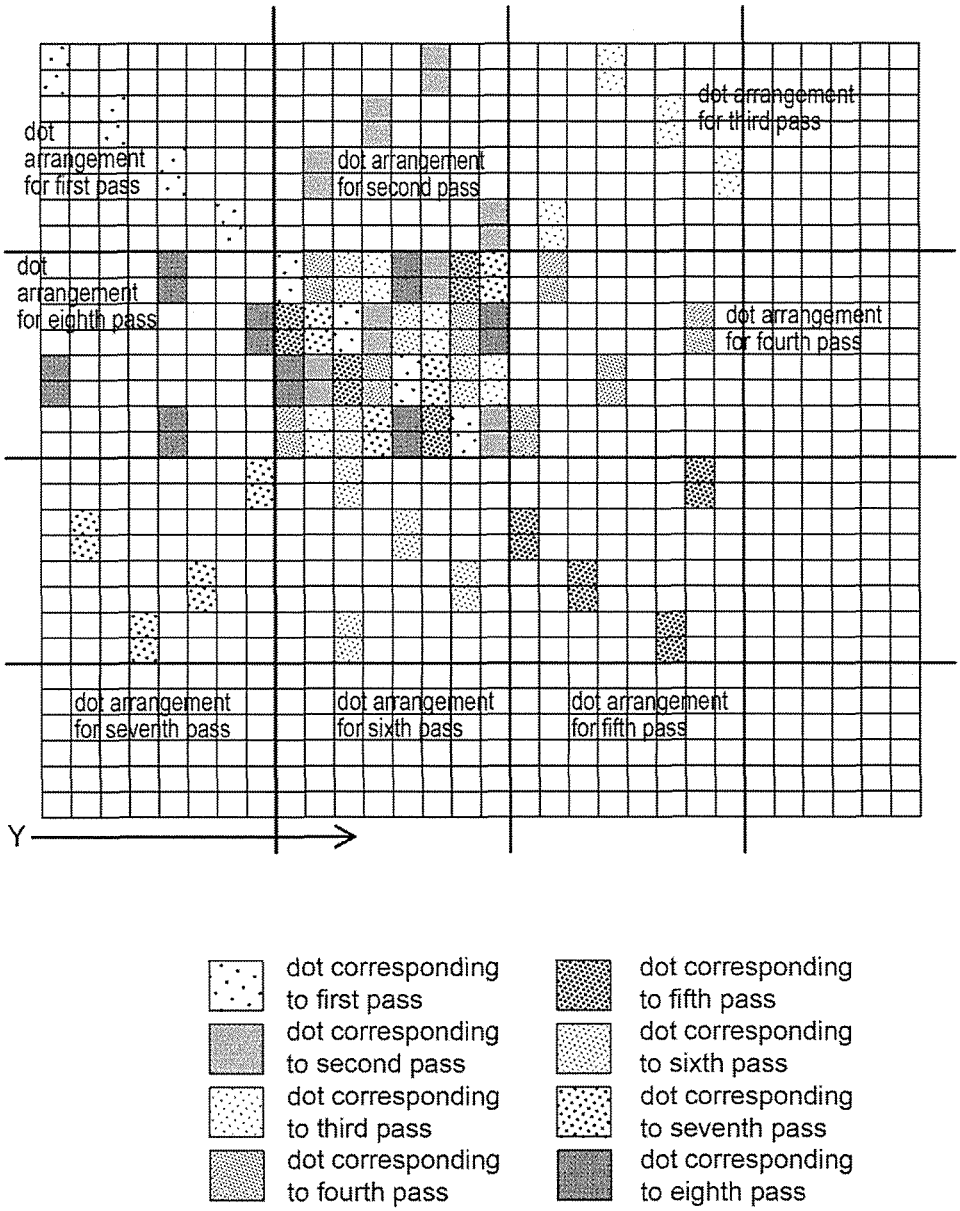
FIG. 9 is a view illustrating another example of the configuration in which different spatial frequencies are set for printing passes, respectively.
Figure 10:
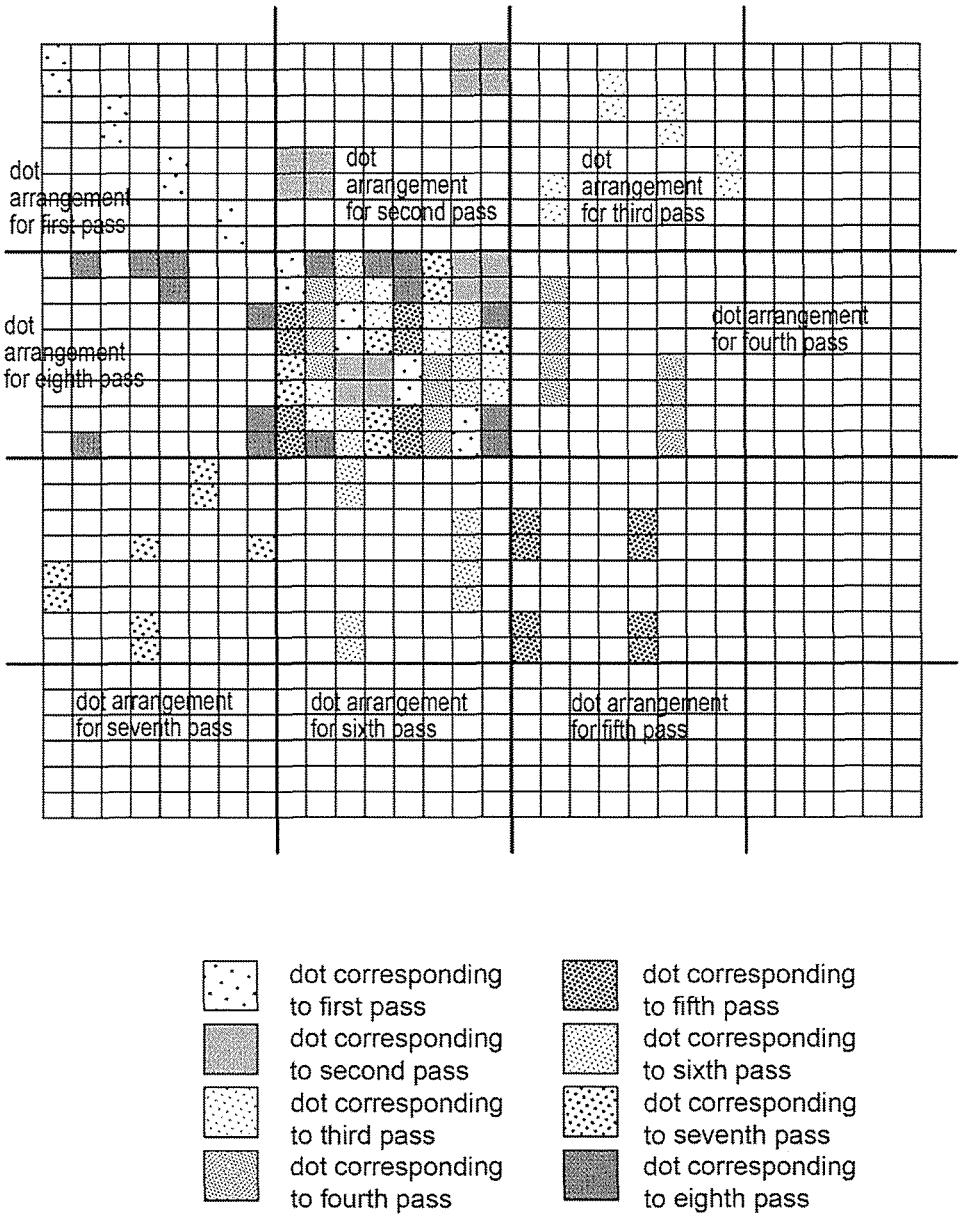
FIG. 10 is a view illustrating another example of the configuration in which different spatial frequencies are set for printing passes, respectively.
Figure 11:
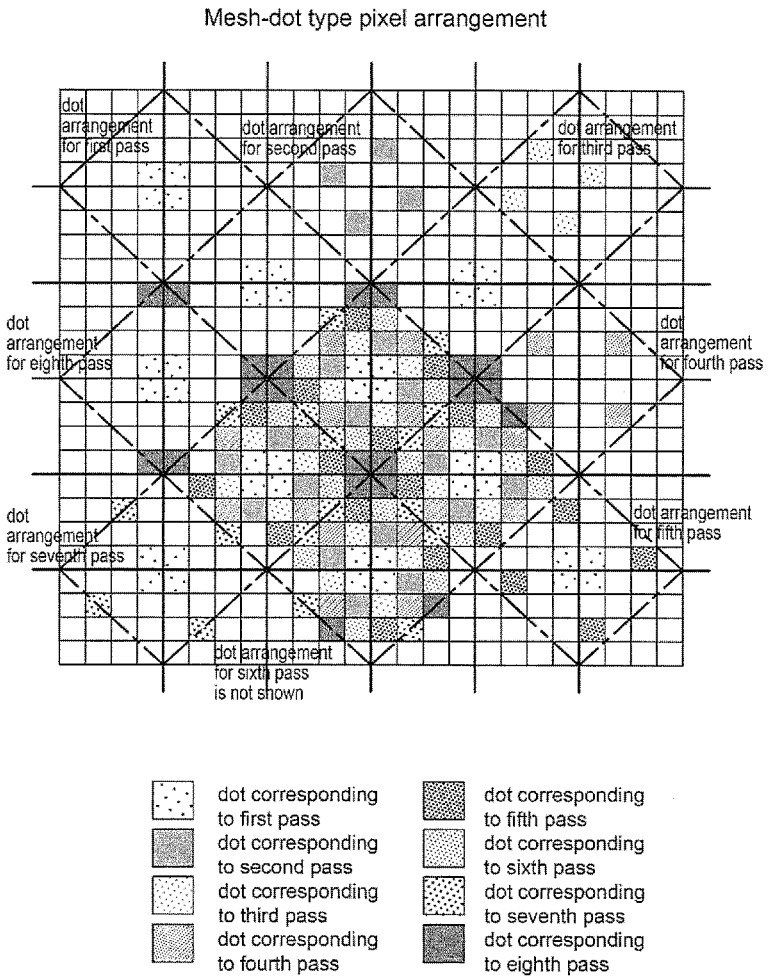
FIG. 11 is a view illustrating another example of the configuration in which different spatial frequencies are set for printing passes, respectively.

FIG. 9 and FIG. 10 are views illustrating other examples of the configuration in which different spatial frequencies are set for printing passes, respectively, and show, as examples, cases of selecting pixels by mixed dot arrangements which are dot arrangements in which there are various patterns having different spatial frequencies together, respectively, when the number of printing passes is 8. FIG. 11 is a view illustrating another example of the configuration in which different spatial frequencies are set for printing passes, respectively, and shows, as an example, a case of selecting pixels by a mesh-dot type pixel arrangement which is a dot arrangement using mesh-dot type patterns when the number of printing passes is 8.

According to these configurations, for example, as patterns for selecting pixels during a plurality of individual printing passes, a plurality of types of patterns having different spatial frequencies can be appropriately used. In this case, it is possible to appropriately prevent density irregularity from occurring, for example, in a print result image.

Figure 12A:
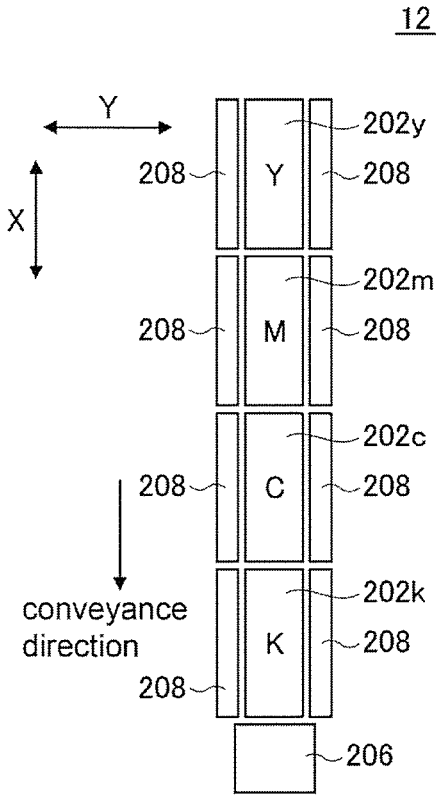
FIG. 12(*a*) and FIG. 12(*b*) are views illustrating modifications of the configuration of the ink dot former 12.
Figure 12B:
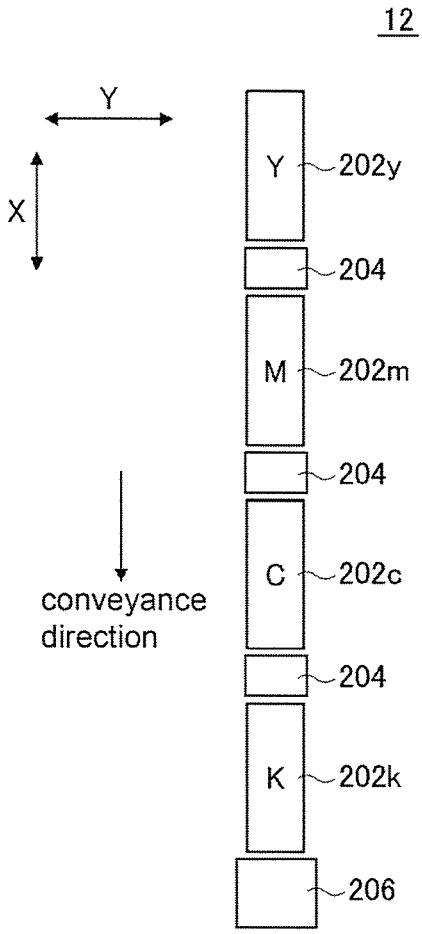

Until now, mainly, with respect to the case of using the ink dot former 12 having the configuration shown in FIG. 2, the configuration in which different spatial frequencies are set for individual printing passes, and so on have been described. However, as the ink dot former 12, for example, a configuration different from the configuration shown in FIG. 2 may be used. Now, various modifications of the configuration of the ink dot former 12 will be described. FIG. 12(*a*) and FIG. 12(*b*) show modifications of the configuration of the ink dot former 12. Also, in FIG. 12(*a*) and FIG. 12*b*), components denoted by the same reference symbols as those of FIGS. 1(*a*), 1(*b*) to 11 have features identical or similar to the components of FIGS. 1(*a*), 1(*b*) to 11, except for points to be described below.

FIG. 12(*a*) shows a first modification of the configuration of the ink dot former 12. In the present modification, the ink dot former 12 has a configuration obtained by omitting the temporarily hardening light sources 204 from the configuration shown in FIG. 2 and so on. Therefore, in this configuration, the ink dot former 12 temporarily hardens ultraviolet curing ink on a medium by only the temporarily hardening light sources 208.

Even in the present modification, the inkjet heads 202*y* to 202*k* are arranged such that printing is performed in the color-sequential mode, similarly in the configuration described with reference to FIG. 2 and so on. For this reason, in a case of performing printing in a multi-pass mode, it is unnecessary to consider, for example, intercolor bleeding. Therefore, it is possible to appropriately reduce the number of printing passes, as compared to a case of ejecting ink drops of all the colors in each main scan operation, for example, like an inkjet printer according to the related art. Also, it is possible to appropriately reduce the intensity of ultraviolet light which is radiated by the temporarily hardening light sources 208. Therefore, even in the present modification, it becomes possible to more easily and appropriately set the intensity of ultraviolet light which is radiated by the temporarily hardening light sources 208 in order to temporarily harden ink dots, within a practical range. Therefore, even in the present modification, for example, it is possible to more appropriately perform high-quality printing.

Also, even in other points, it is possible to achieve various effects, for example, similarly to the configuration described with reference to FIGS. 1(*a*), 1(*b*) to 11. More specifically, for example, even in the present modification, it is possible to appropriately prevent occurrence of hardened streaks and so on by temporarily hardening ultraviolet curing ink on a medium by the temporarily hardening light sources 208.

Also, even in the present modification, in printing in a multi-pass mode, for example, similarly in the configuration described with reference to FIGS. 1(*a*), 1(*b*) to 11, different spatial frequencies are set for individual printing passes, respectively. As a result, it is possible to appropriately prevent density irregularity from occurring, for example, in a print result image.

FIG. 12(*b*) shows a second modification of the configuration of the ink dot former 12. In the present modification, the ink dot former 12 has a configuration obtained by omitting the temporarily hardening light sources 208 from the configuration shown in FIG. 2 and so on. Therefore, in this configuration, the ink dot former 12 temporarily hardens ultraviolet curing ink on a medium by only the temporarily hardening light sources 204. Also, in this case, after a plurality of main scan operations is performed by the inkjet heads positioned on the upstream side in the medium conveyance direction, the temporarily hardening light sources 204 temporarily harden ink dots formed on a medium by the inkjet heads.

Even in this case, it is possible to appropriately perform temporal hardening on ultraviolet curing ink on a medium by irradiating the ink with weak ultraviolet light by the temporarily hardening light sources 204. Also, in this case, whenever each main scan operation is performed, ultraviolet light is not always radiated, and each position on a medium is irradiated with weak ultraviolet light whenever as many main scan operations as the number of printing passes are performed on the corresponding position. Therefore, even in a case of performing printing in a multi-pass mode, it is enough to irradiate each position on a medium with weak ultraviolet light, for example, only once. Therefore, according to the present modification, for example, it becomes possible to more easily and appropriately set the intensity of ultraviolet light which is radiated by the temporarily hardening light sources 204, within a practical range. Therefore, even in the present modification, for example, it is possible to more appropriately perform high-quality printing.

Also, even in other points, it is possible to achieve various effects, for example, similarly to the configuration described with reference to FIGS. 1(*a*), 1(*b*) to 11 or the configuration shown in FIG. 12(*a*). For example, even in the present modification, it is possible to appropriately prevent occurrence of hardened streaks and so on by temporarily hardening ultraviolet curing ink on a medium by the temporarily hardening light sources 204. Also, by setting different spatial frequencies for individual printing passes, respectively, it is possible to appropriately prevent density irregularity from occurring, for example, in a print result image.

With reference to FIGS. 1(*a*), 1(*b*) to 12(*a*), 12(*b*), the configuration in a case of performing printing with ultraviolet curing ink of all the colors by the color-sequential mode has been described. However, in order to appropriately perform temporal hardening on ink dots, it is not necessarily needed to perform printing with respect to all the colors in the color-sequential mode, and for example, it can also be considered to reduce the number of colors of ink dots which are formed in each main scan operation. More specifically, for example, with respect to a case of performing printing with ultraviolet curing ink of N-number of different colors, it can be considered to install N-number of inkjet heads corresponding to the N-number of colors such that the number of colors of ink dots which are formed in a band area corresponding to each printing pass in each main scan operation becomes smaller than N. According to this configuration, for example, with respect to ink dots of each color to be formed in a band area, it becomes easy to set an arrangement in which the distance between dots is long. Also, as a result, it is possible to make contact of liquid ink dots unlikely to occur. Therefore, even in this configuration, similarly in the case of performing printing by the color-sequential mode, it is possible to appropriately prevent occurrence of intercolor bleeding and so on. Now, however, modification of the ink dot former 12 will be described, with respect to the above described case.

Figure 13A:
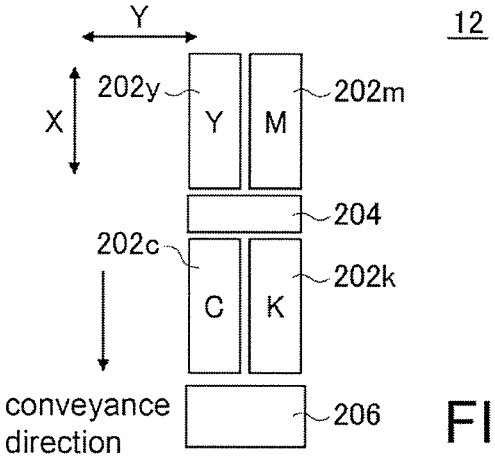
FIG. 13(*a*)~FIG. 13(*c*) are views illustrating other modifications of the configuration of the ink dot former 12.
Figure 13B:
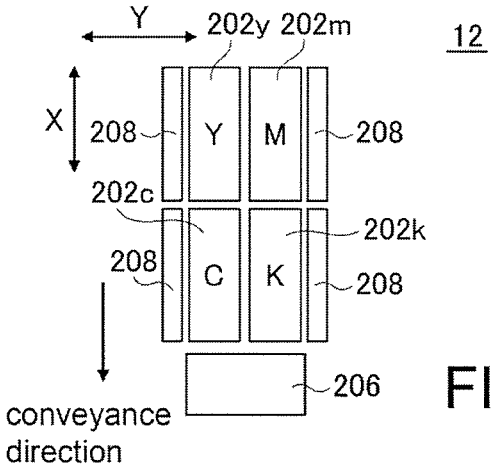
Figure 13C:
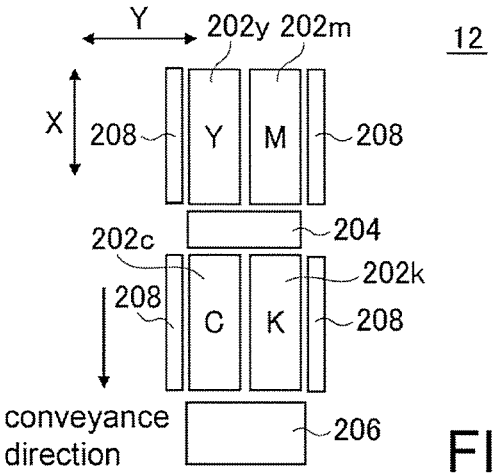

FIG. 13(*a*)~FIG. 13(*c*) show other modifications of the configuration of the ink dot former 12. Also, in FIG. 13(*a*)~FIG. 13(*c*), components denoted by the same reference symbols as those of FIGS. 1(*a*), 1(*b*) to 12(*a*), 12(*b*) have features identical or similar to the components of FIGS. 1(*a*), 1(*b*) to 12(*a*), 12(*b*) except for points to be described below. Also, the configurations shown in FIG. 13(*a*)~FIG. 13(*c*), the inkjet head 202*y* is an example of the first-color head. The inkjet head 202*c* is an example of the second-color head. Also, the inkjet head 202*m* is an example of a third-color head. The inkjet head 202*k* is an example of a fourth-color head.

FIG. 13(*a*) shows a third modification of the configuration of the ink dot former 12. In the present modification, the plurality of inkjet heads 202*y* to 202*k* is divided into two groups each of which includes inkjet heads corresponding to two colors. Further, inkjet heads included in a group are installed such that their positions do not overlap inkjet heads included in the other group in the sub scan direction.

More specifically, in the configuration shown in FIG. 13(*a*), the inkjet head 202*y* and the inkjet head 202*m* are included in a first group. Also, the inkjet head 202*c* and the inkjet head 202*k* are included in a second group. Further, the inkjet head 202*y* and the inkjet head 202*c* are installed side by side in the sub scan direction, such that their positions are aligned in the main scan direction and do not overlap each other in the sub scan direction. Also, the inkjet head 202*m* is aligned in the sub scan direction, and is installed side by side with the inkjet head 202*y* in the main scan direction. The inkjet head 202*k* is aligned in the sub scan direction, and is installed side by side with the inkjet head 202*c* in the main scan direction.

Further, in the present modification, the ink dot former 12 has a temporarily hardening light source 204 between the inkjet head 202*y* and the inkjet head 202*m* which are inkjet heads of the first group and the inkjet head 202*c* and the inkjet head 202*k* which are inkjet heads of the second group. Also, the ink dot former has the fully hardening light source 206 on the downstream side from the inkjet heads of the second group in the medium conveyance direction.

Also, according to these components, onto each position on a medium, the inkjet head 202*y* and the inkjet head 202*m* eject ink drops of the Y color and the M color in a main scan operation which is determined according to the corresponding position on the medium. After the inkjet head 202*y* and the inkjet head 202*m* eject ink drops of the Y color and the M color, in another main scan operation, the inkjet head 202*c* and the inkjet head 202*k* eject ink drops of the C color and the K color, respectively. Also, after the inkjet head 202*y* and the inkjet head 202*m* eject ink drops of the Y color and the M color, with respect to each position of the medium, the temporarily hardening light sources 204 harden the ultraviolet curing ink of the Y color and the M color on the medium to the temporarily hardened state before the inkjet head 202*c* and the inkjet head 202*k* eject ink drops of the C color and the K color. Thereafter, the inkjet head 202*c* and the inkjet head 202*k* eject ink drops of the C color and the K color onto the area where the ultraviolet curing ink of the Y color and the M color has hardened to the temporarily hardened state.

According to this configuration, for example, it is possible to appropriately reduce the number of colors of ink dots which are formed in a band area of each printing pass in each main scan operation. Therefore, even in this case, it is possible to make it difficult for intercolor bleeding to occur, as compared to a case of ejecting ink drops of all the colors in each main scan operation. Therefore, even in the present modification, for example, with respect to ink dots which are formed on a medium, it is possible to appropriately perform temporal hardening. Therefore, for example, it is possible to appropriately perform high-quality printing.

Also, even in the present modification, in printing in a multi-pass mode, for example, similarly in the configuration described with reference to FIGS. 1(*a*), 1(*b*) to 11, different spatial frequencies are set for individual printing passes, respectively. As a result, it is possible to appropriately prevent density irregularity from occurring, for example, in a print result image.

In the present modification, unlikely to the case of performing printing with individual colors by the color-sequential mode, in each main scan operation, ink dots of a plurality of colors are formed in one band area. Therefore, in this case, it is desirable to perform printing in the multi-pass mode such that ink drops of different colors are not ejected onto any of the same pixel and adjacent pixels in the main scan direction. According to this configuration, for example, with respect to ink dots of different colors, it is possible to appropriately secure the distance between dots during the same pass. Also, as a result, it is possible to appropriately prevent intercolor bleeding due to the connection of ink dots of different colors.

Also, the number of groups into which the inkjet heads are divided is not limited to 2, and may be, for example, 3 or greater. Also, the number of colors of ink which is used in printing is not limited to the four colors of C, M, Y, and K, and may be a greater number. For example, more generally, with respect to a case of using ultraviolet curing ink of N-number of colors, it can be considered to divide the N-number of colors into k-number of groups each of which includes one or more colors (wherein k is an integer equal to or greater than 2 and less than N, for example, 2 or 3). In this case, inkjet heads for ejecting ink drops of the N-number of colors are installed, for example, such that their positions in the sub scan direction do not overlap each other in each group.

FIG. 13(*b*) shows a fourth modification of the configuration of the ink dot former 12. Also, the configuration of the present modification has features identical or similar to those of the configuration shown in FIG. 13(*a*), except for points to be described below.

In the present modification, the ink dot former 12 has a plurality of temporarily hardening light sources 208, in place of the temporarily hardening light sources 204 shown in FIG. 13(*a*). The individual temporarily hardening light sources 208 are installed at positions adjacent to the inkjet heads included in the individual groups, in the main scan direction. Therefore, in each main scan operation, the temporarily hardening light sources 208 temporarily harden ink dots formed in the corresponding main scan operation. Even in the present modification, for example, with respect to ink dots which are formed on a medium, it is possible to appropriately perform temporal hardening. Therefore, for example, it is possible to appropriately perform high-quality printing.

Also, even in the present modification, for example, it is possible to appropriately reduce the number of colors of ink dots which are formed in a band area corresponding to each printing pass. Therefore, even in this case, for example, similarly to the configuration shown in FIG. 12(*a*), it becomes possible to more easily and appropriately set the intensity of ultraviolet light which is radiated by the temporarily hardening light sources 208, within a practical range.

Also, even in the present modification, in printing in a multi-pass mode, for example, similarly in the configuration described with reference to FIGS. 1(*a*), 1(*b*) to 11, different spatial frequencies are set for individual printing passes, respectively. As a result, it is possible to appropriately prevent density irregularity from occurring, for example, in a print result image.

Further, in case of the present modification, for example, it is possible to temporarily harden ink dots whenever a main scan operation corresponding to each printing pass is performed. Therefore, according to the present modification, for example, with respect to a plurality of colors which is produced by a plurality of inkjet heads included in the same group, it is possible to more appropriately prevent intercolor bleeding from occurring.

FIG. 13(*c*) shows a fifth modification of the configuration of the ink dot former 12. Also, the configuration of the present modification has features identical or similar to those of the configurations shown in FIG. 13(*a*) and FIG. 13(*b*), except for points to be described below.

In the present modification, the ink dot former 12 further includes temporarily hardening light sources 208 at positions adjacent to the inkjet heads of the individual groups in the main scan direction, in addition to a temporarily hardening light source 204 which is installed between the inkjet heads of the individual groups in the sub scan direction. Even in this case, for example, similarly to the cases described in association with the above described individual modifications, with respect to ink dots which are formed on a medium, it is possible to appropriately perform temporal hardening. Therefore, for example, it is possible to appropriately perform high-quality printing.

Also, even in the present modification, in printing in a multi-pass mode, for example, similarly in the configuration described with reference to FIGS. 1(*a*), 1(*b*) to 11, different spatial frequencies are set for individual printing passes, respectively. As a result, it is possible to appropriately prevent density irregularity from occurring, for example, in a print result image.

Figure 14A:
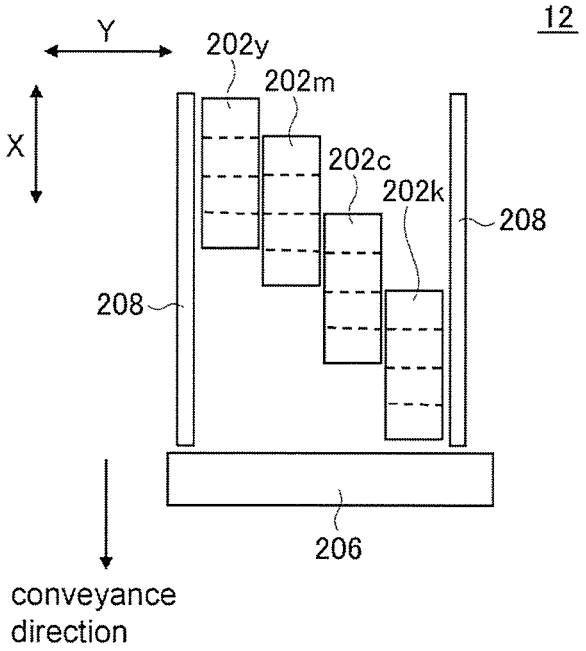
FIG. 14(*a*) and FIG. 14(*b*) are views illustrating other modifications of the ink dot former 12.
Figure 14B:
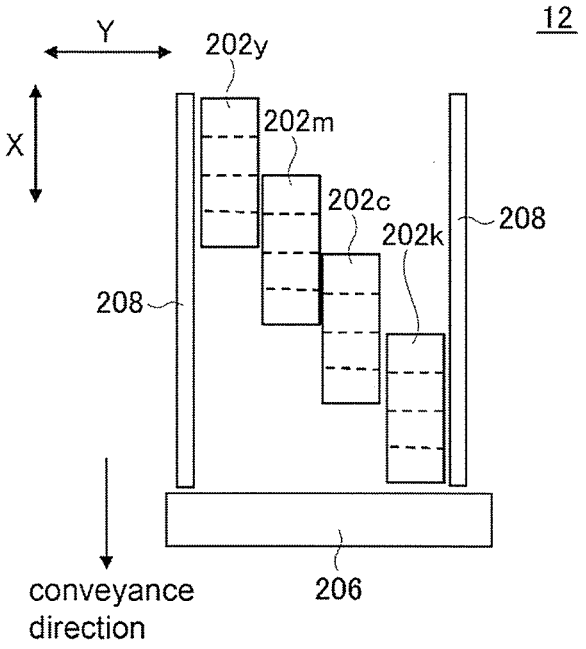

Now, with respect to a configuration for reducing the number of colors of ink dots which are formed in the same area in each main scan operation, other modifications will be shown. FIG. 14(*a*) and FIG. 14(*b*) show other modifications of the ink dot former 12. Also, in FIG. 14(*a*) and FIG. 14(*b*), components denoted by the same reference symbols as those of FIGS. 1(*a*), 1(*b*) to 13(*a*)~13(*c*) have features identical or similar to the components of FIGS. 1(*a*), 1(*b*) to 13(*a*)~13(*c*), except for points to be described below. Also, in the configurations shown in FIG. 14(*a*) and FIG. 14(*b*), the inkjet head 202*y* is an example of the first-color head. The inkjet head 202*m* is an example of the second-color head. Also, the inkjet head 202*c* is an example of the third-color head. The inkjet head 202*k* is an example of the fourth-color head.

FIG. 14(*a*) shows a sixth modification of the configuration of the ink dot former 12. FIG. 14(*b*) shows a seventh modification of the configuration of the ink dot former 12. In these modifications, the inkjet heads 202*y* to 202*k* are installed such that their positions in the sub scan direction partially overlap adjacent inkjet heads in the main scan direction while their positions in the sub scan direction are deviated from each other by a pass width or more. In this case, the pass width is the width of one printing pass in the sub scan direction.

Also, more specifically, in the modifications shown in FIG. 14(*a*) and FIG. 14(*b*), the inkjet heads 202*y* to 202*k* are installed side by side in the main scan direction such that their positions are sequentially deviated from each other by a distance which is the product of the pass width and an integer. For example, in FIG. 14(*a*) and FIG. 14(*b*), the width of each of areas into which the insides of the inkjet heads 202*y* to 202*k* are divided by broken lines represents a pass width. More specifically, in FIG. 14(*a*) and FIG. 14(*b*), with respect to four areas into which each of the inkjet heads 202*y* to 202*k* is divided by broken lines, a pass width is the width of each area in the X direction. Further, in case of the configuration shown in FIG. 14(*a*), the inkjet heads 202*y* to 202*k* are installed such that their positions are sequentially deviated from each other in the sub scan direction by a distance equal to a pass width. Also, in case of the configuration shown in FIG. 14(*b*), the inkjet heads 202*y* to 202*k* are installed such that their positions are sequentially deviated from each other in the sub scan direction by a distance equal to twice a pass width (a distance corresponding to two passes). According to these configurations, for example, it is possible to appropriately reduce the number of colors of ink dots which are formed in a band area corresponding to each printing pass, in each main scan operation.

Also, in each modification shown in FIG. 14(*a*) and FIG. 14(*b*), the ink dot former 12 has temporarily hardening light sources 208 on both sides of the inkjet heads 202*y* to 202*k* in the main scan direction. In this case, the temporarily hardening light sources 208 harden ink dots formed at each position on a medium in each main scan operation, to the temporarily hardened state, before the next main scan operation on the same position is performed. Also, with respect to each position on the medium, after all main scan operations of ejecting ink drops onto the corresponding position are performed, the fully hardening light source 206 irradiates the corresponding position with ultraviolet light.

Even in this case, it becomes possible to more easily and appropriately set the intensity of ultraviolet light which is radiated by the temporarily hardening light sources 208, within a practical range, by reducing the number of colors of ink dots which are formed in each band area in each main scan operation. Therefore, even in these modifications, for example, it is possible to appropriately perform temporal hardening on ink dots which are formed in each main scan operation. Therefore, for example, it is possible to appropriately perform high-quality printing.

Also, even in these modifications, in printing in a multi-pass mode, for example, similarly in the configuration described with reference to FIGS. 1(*a*), 1(*b*) to 11, different spatial frequencies are set for individual printing passes, respectively. As a result, it is possible to appropriately prevent density irregularity from occurring, for example, in a print result image.

With respect to the inkjet heads of the individual colors for printing, spatial frequencies corresponding to individual printing passes, and the like have been described with focus on an inkjet head for one color. However, in order to perform higher-quality printing, for example, with respect to selection of pixels to be formed in the same band area by the same main scan operation, like the spatial frequencies of pixels to be formed in the same area on a medium differ depending on colors, it can also be considered to set different masks for selecting pixels not only for passes but also for colors. According to this configuration, for example, it is possible to set different spatial frequencies for individual colors for printing, respectively while setting different spatial frequencies for individual printing passes, respectively. Also, as a result, it is possible to appropriately perform higher-quality printing. Hereinafter, this configuration will be described in more detail.

Figure 15A:
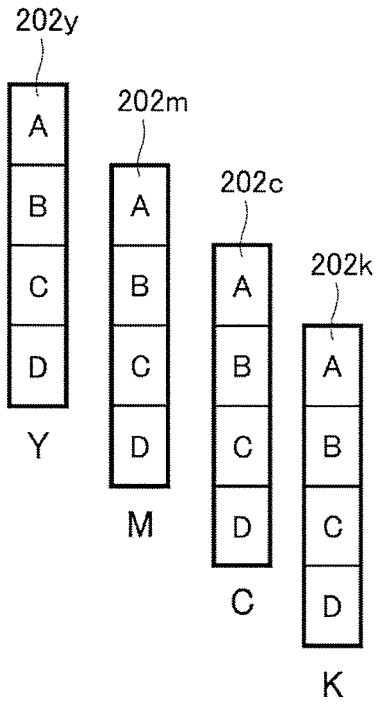
FIG. 15(*a*) and FIG. 15(*b*) are views illustrating examples of a specific configuration in a case of setting different spatial frequencies for individual colors.
Figure 15B:
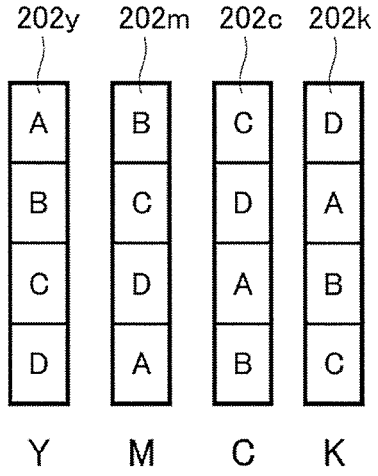

FIG. 15(*a*) and FIG. 15(*b*) show an example of a specific configuration in a case of setting different spatial frequencies for individual colors. Also, in FIG. 15(*a*) and FIG. 15(*b*), components denoted by the same reference symbols as those of FIGS. 1(*a*), 1(*b*) to 14(*a*) and 14(*b*) have features identical or similar to the components of FIGS. 1(*a*), 1(*b*) to 14(*a*) and 14(*b*), except for points to be described below.

FIG. 15(*a*) is a view illustrating a first example of the configuration in which different spatial frequencies are set for individual colors, and shows a configuration in which different spatial frequencies are set for individual colors, in a case of installing the inkjet heads 202*y* to 202*k* such that the inkjet heads have the configuration shown in FIG. 14(*a*).

In this configuration, the inkjet heads 202*y* to 202*k* are installed such that their positions are sequentially deviated from each other in the sub scan direction by a distance equal to a pass width. Therefore, in this case, if mask patterns are set for the inkjet heads 202*y* to 202*k* as shown in the drawing, the masks of the individual inkjet heads corresponding to the same band area are different from one another.

More specifically, for example, in a case of setting the mask patterns "A" to "D" with respect to the individual inkjet heads 202*y* to 202*k* as shown in FIG. 7(*a*)~FIG. 7(*e*), patterns which are set for portions of the inkjet heads having the same position in the sub scan direction are different from one another. Therefore, according to this configuration, for example, with respect to selection of pixels onto which ink drops are ejected during each printing pass, it is possible to appropriately set different spatial frequencies between pixels in a band area corresponding to one printing pass, for example, for inkjet heads for individual colors of C, M, Y, and K. Also, as a result, it is possible to appropriately implement a configuration in which density irregularity is more unlikely to occur, for example, in a final print result image, and appropriately perform higher-quality printing.

Also, even in other configurations, it is effective to set different spatial frequencies for individual colors. Therefore, for example, even in various arrangements of the inkjet heads 202*y* to 202*k* described with reference to FIGS. 1(*a*), 1(*b*) to 14(*a*) and 14(*b*), it is preferable to set different spatial frequencies for individual colors. In this case, with respect to selection of pixels onto which ink drops are ejected during each printing pass, the controller 20 (see FIG. 1(*a*) and FIG. 1(*b*)) sets different spatial frequencies between pixels in a band area corresponding to one printing pass, for example, for inkjet heads for individual colors of C, M, Y, and K. According to this configuration, it is possible to appropriately implement a configuration in which density irregularity is more unlikely to occur, for example, in a final print result image, and appropriately perform higher-quality printing.

Also, according to the quality of printing required, for example, with respect to N-number of inkjet heads, it can be considered to install the inkjet heads, for example, such that the number of colors of dots which are formed in each band area becomes N like in the related art, without installing the inkjet heads such that the number of colors of ink dots which are formed in each band area becomes smaller than N. Even in this case, for example, even with respect to spatial frequencies of pixels to be formed in the same area on a medium during each printing pass, it can be considered to set different spatial frequencies for individual ink colors.

FIG. 15(*b*) is a view illustrating a second example of the configuration in which different spatial frequencies are set for individual colors, and shows, as an example, a case where the plurality of inkjet heads 202*y* to 202*k* is installed to be aligned in the sub scan direction. In this case, the number of colors of dots which are formed in each band area becomes the number of all colors which are used for printing.

Even in this configuration, for example, by setting the mask patterns "A" to "D" as shown in the drawing, it is possible to appropriate set different spatial frequencies for individual passes and individual colors. Therefore, even in this case, it is possible to appropriately implement a configuration in which density irregularity is unlikely to occur, for example, in a print result image.

Now, a more specific configuration of the inkjet heads 202*y* to 202*k* will be described in more detail. In each configuration described above, as each of the inkjet heads 202*y* to 202*k*, for example, an inkjet head identical or similar to a known inkjet head can be suitably used. Also, more specifically, for example, an inkjet head having nozzle rows in which a plurality of nozzles is arranged in line in the sub scan direction can be suitably used. Also, in this case, for example, a configuration in which each of the inkjet heads 202*y* to 202*k* has one nozzle row can be suitably used.

Also, other configurations such as a configuration in which each of the inkjet heads 202*y* to 202*k* has a plurality of nozzle rows can be considered. Now, the case where each of the inkjet heads 202*y* to 202*k* has a plurality of nozzle rows will be described in more detail.

Figure 16A:
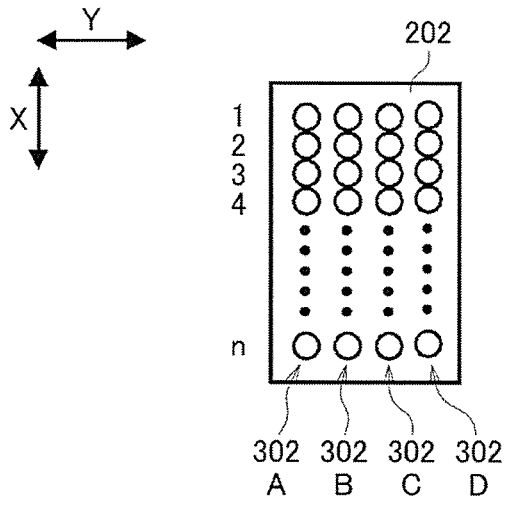
FIG. 16(*a*) and FIG. 16(*b*) are views for explaining an example of a configuration and an operation in a case of using an inkjet head 202 having a plurality of nozzle rows 302.
Figure 16B:
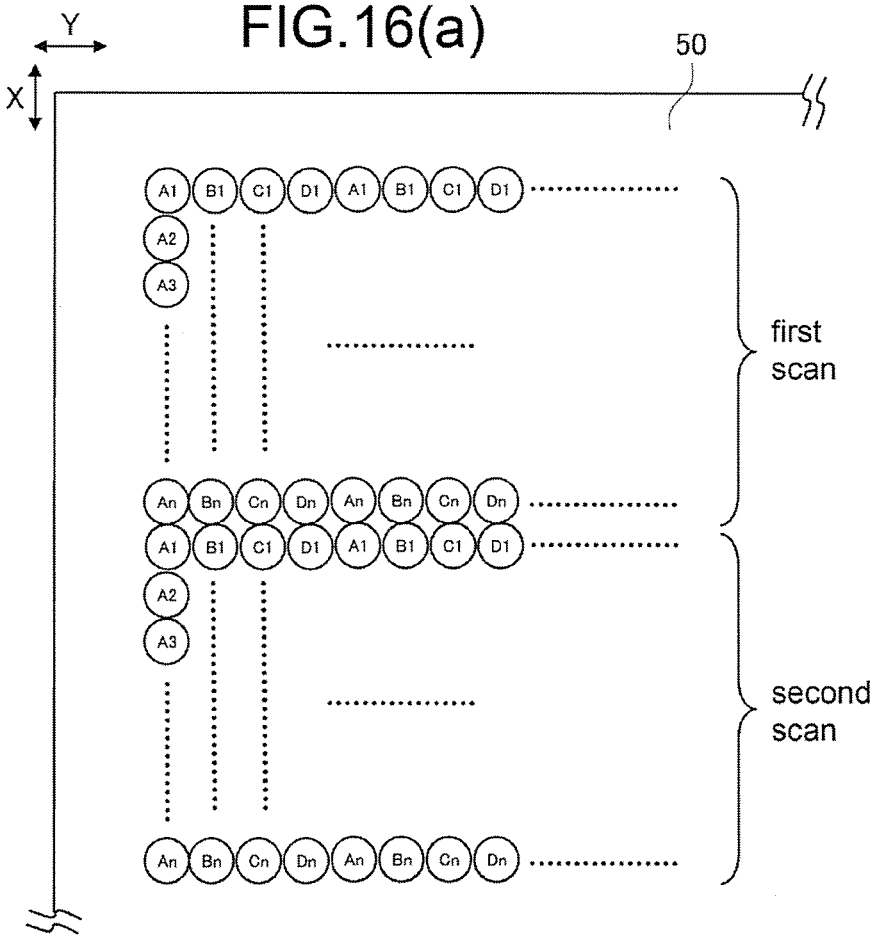

FIG. 16(*a*) and FIG. 16(*b*) are views for explaining examples of a configuration and an operation in a case of using inkjet heads 202 each of which has a plurality of nozzle rows 302. FIG. 16(*a*) shows an example of the configuration of an inkjet head 202. FIG. 16(*b*) shows an example of a printing operation which is performed using the inkjet head 202. Also, in FIG. 16(*a*) and FIG. 16(*b*) components denoted by the same reference symbols as those of FIGS. 1(*a*), 1(*b*) to 15(*a*) and 15(*b*) have features identical or similar to the components of FIGS. 1(*a*), 1(*b*) to 15(*a*) and 15(*b*), except for points to be described below. Further, the inkjet head 202 of FIG. 16(*a*) and FIG. 16(*b*) is an inkjet head corresponding to each of the inkjet heads 202*y* to 202*k* of FIGS. 1(*a*), 1(*b*) to 15(*a*) and 15(*b*).

As shown in FIG. 16(*a*), in this case, the inkjet head 202 has a plurality of nozzle rows 302 each having a plurality of nozzles arranged in line in the sub scan direction. Also, the plurality of nozzle rows 302 is arranged side by side in the main scan direction. More specifically, in the case shown in the drawing, the inkjet head 202 has four nozzle rows 302 distinguished by attaching reference symbols "A" to "D" in the drawing. Also, in each nozzle row 302, n-number of nozzles denoted by numbers "1" to "n" are arranged in line.

Therefore, in this configuration, for example, as shown in FIG. 16(*b*), in each main scan operation, it is possible to eject ink drops from the plurality of nozzle rows 302 onto an area of a medium 50 on which the corresponding main scan operation is performed. Therefore, according to this configuration, for example, by one main scan operation, it is possible to perform printing identical or similar to printing which is performed by as many printing passes as the number of the nozzle rows.

Further, in FIG. 16(*b*), A1 to An represent ink dots which are formed by the first to n-th nozzles of a nozzle row 302 which is the A row. Also, similarly, B1 to Bn represent ink dots which are formed by the first to n-th nozzles of a nozzle row 302 which is the B row. C1 to Cn represent ink dots which are formed by the first to n-th nozzles of a nozzle row 302 which is the C row. D1 to Dn represent ink dots which are formed by the first to n-th nozzles of a nozzle row 302 which is the D row. Also, portions shown as a first scan portion and a second scan portion represent areas on which printing is performed in different main scan operations between which a sub scan operation is performed, respectively.

Also, in FIG. 16(*b*), for convenience of illustration, with respect to a case where the width of a band area is set to be equal to the length of the nozzle rows, printing states during the first scan and the second scan are shown. However, even in the case of using the inkjet head 202 having the plurality of nozzle rows 302, printing may be performed in a multi-pass mode.

For example, in the configuration in which the number of nozzle rows is four, it can be considered to perform printing in a multi-pass mode in which the number of printing passes is two. According to this configuration, for example, by one nozzle row, it is possible to perform printing similar to the case where printing is performed by eight printing passes. Also, for example, in the configuration in which the number of nozzle rows is four, it can be considered to perform printing in a multi-pass mode in which the number of printing passes is four. According to this configuration, for example, by one nozzle row, it is possible to perform printing similar to the case where printing is performed by sixteen printing passes.

Also, in this case of performing printing in a multi-pass mode, for example, similarly in the case described with reference to FIGS. 1(*a*), 1(*b*) to 15(*a*) and 15(*b*) with respect to inkjet heads for individual colors, it can be considered to set different spatial frequencies for individual printing passes. According to this configuration, it is possible to appropriately prevent density irregularity from occurring, for example, in a print result image. Also, as a result, for example, it is possible to appropriately perform high-quality printing.

Although the disclosure has been described above by way of the embodiment, the technical scope of the disclosure is not limited to the scope described in the embodiment. It is apparent to those skilled in the art that it is possible to make various changes or modifications in the above described embodiment. It is apparent from a description of claims that forms obtained by making such changes or modifications can also be included in the technical scope of the disclosure.

INDUSTRIAL APPLICABILITY

The disclosure can be suitably used, for example, in printing devices.

The invention claimed is:

1. A printing apparatus which performs printing on a medium with an ultraviolet curing ink of N-number of different colors in an inkjet mode by a multi-pass mode for performing printing on each position on the medium by a plurality of printing passes, wherein N is an integer of 2 or greater, and the printing apparatus comprising:

N-number of inkjet heads configured to eject ink drops of the ultraviolet curing ink of the N-number of colors, respectively;

a main scan driver configured to drive the N-number of inkjet heads to perform main scan operations of ejecting ink drops while moving in a main scan direction which is predetermined;

a sub scan driver configured to relatively move the N-number of inkjet heads with respect to the medium in a sub scan direction perpendicular to the main scan direction;

temporarily hardening light sources configured to radiate ultraviolet light which hardens the ultraviolet curing ink on the medium to a temporarily hardened state which is a state where at least a surface of the ultraviolet curing ink has adhesiveness;

a fully hardening light source configured to radiate ultraviolet light which completes hardening of the ultraviolet curing ink on the medium; and a pixel selector configured to select pixels onto which ink drops are ejected during each printing pass of the multi-pass mode, wherein the N-number of inkjet heads are installed such that the number of colors of ink dots which are formed in a band area corresponding to each printing pass in each main scan operation becomes smaller than N, whenever a predetermined number of main scan operations are performed on each position on the medium, the temporarily hardening light sources radiate ultraviolet light which hardens the ultraviolet curing ink to the temporarily hardened state, and after main scan operations of all printing passes on each position on the medium finish, the fully hardening light source radiates ultraviolet light, wherein the N-number of inkjet heads include at least:

a first-color head that is an inkjet head configured to eject first-color ink drops which are ink drops of the ultraviolet curing ink of a first color, and a second-color head that is an inkjet head configured to eject second-color ink drops which are ink drops of the ultraviolet curing ink of a second color different from the first color, the first-color head and the second-color head are installed such that their positions in the sub scan direction are displaced from each other, with respect to each position on the medium, the first-color head ejects the first-color ink drops in one of the main scan operations which is determined according to the position on the medium, and after the first-color head ejects the first-color ink drops, in another main scan operation, the second-color head ejects the second-color ink drops, with respect to each position on the medium, after the first-color head ejects the first-color ink drops, the temporarily hardening light sources harden the ultraviolet curing ink of the first color on the medium, to the temporarily hardened state, before the second-color head ejects the second-color ink drops, and the second-color head ejects the second-color ink drops onto an area where the ultraviolet curing ink of the first color has hardened to the temporarily hardened state.

2. The printing apparatus according to claim 1, wherein in selection of pixels onto which ink drops are ejected during each printing pass, the pixel selector sets different spatial frequencies representing intervals between pixels onto which ink drops are ejected during each printing pass, for a first printing pass and a second printing pass which are consecutively performed on a same area on the medium.

3. The printing apparatus according to claim 1, wherein printing is performed in the multi-pass mode such that ink drops of different colors are not ejected onto any of same pixel and adjacent pixels in the main scan direction during same printing pass.

4. The printing apparatus according to claim 1, wherein the printing apparatus performs printing on the medium by a multi-pass mode in which the number of passes is k, wherein k is an integer of 2 or greater, and in selection of pixels onto which ink drops are ejected during each printing pass, the pixel selector selects the pixels, such that, during printing passes more than half of the k-number of printing passes, ink drops of same color are not ejected onto adjacent pixels in the main scan direction by same printing pass.

5. The printing apparatus according to claim 1, wherein with respect to each position on the medium, the temporarily hardening light sources harden ink dots formed by ink drops ejected onto the medium in a main scan operation during each printing pass, to the temporarily hardened state, before a main scan operation corresponding to another printing pass is performed on same position.

6. The printing apparatus according to claim 1, wherein the first-color head and the second-color head are installed side by side in the sub scan direction such that their positions in the sub scan direction do not overlap each other.

7. The printing apparatus according to claim 1, wherein the N-number of inkjet heads further include:

a third-color head that is an inkjet head configured to eject third-color ink drops which are ink drops of the ultraviolet curing ink of a third color different from both of the first color and the second color, and a fourth-color head that is an inkjet head configured to eject fourth-color ink drops which are ink drops of the ultraviolet curing ink of a fourth color different from all of the first color, the second color, and the third color, the third-color head is aligned in the sub scan direction, and is installed side by side with the first-color head in the main scan direction, the fourth-color head is aligned in the sub scan direction, and is installed side by side with the second-color head, with respect to each position on the medium, the first-color head and the third-color head eject the first-color ink drops and the third-color ink drops, respectively, in a main scan operation which is determined according to the position on the medium, and after the first-color head and the third-color head eject the first-color ink drops and the third-color ink drops, in another main scan operation, the second-color head and the fourth-color head eject the second-color ink drops and the fourth-color ink drops, respectively, with respect to each position on the medium, after the first-color head and the third-color head eject the first-color ink drops and the third-color ink drops, the temporarily hardening light sources harden the ultraviolet curing ink of the first color and the ultraviolet curing ink of the third color on the medium, to the temporarily hardened state, before the second-color head and the fourth-color head eject the second-color ink drops and the fourth-color ink drops, and the second-color head and the fourth-color head eject the second-color ink drops and the fourth-color ink drops onto an area where the ultraviolet curing ink of the first color and the third color has hardened to the temporarily hardened state.

8. The printing apparatus according to claim 1, wherein each of the first-color head and the second-color head has a plurality of nozzle rows, in each of which a plurality of nozzles is arranged in line in the sub scan direction.

9. The printing apparatus according to claim 1, wherein the N-number of inkjet heads include at least:

a first-color head that is an inkjet head configured to eject first-color ink drops which are ink drops of the ultraviolet curing ink of a first color, and a second-color head that is an inkjet head configured to eject second-color ink drops which are ink drops of the ultraviolet curing ink of a second color different from the first color, and in selection of pixels onto which ink drops are ejected during each printing pass, with respect to spatial frequencies representing intervals between pixels onto which ink drops are ejected and which are included in the band area corresponding to one printing pass, the pixel selector sets spatial frequency of pixels onto which ink drops are ejected by the first-color head and spatial frequency of pixels onto which ink drops are ejected by the second-color head, such that they are different from each other.

10. A printing apparatus which performs printing on a medium with an ultraviolet curing ink of N-number of different colors in an inkjet mode by a multi-pass mode for performing printing on each position on the medium by a plurality of printing passes, wherein N is an integer of 2 or greater, and the printing apparatus comprising:

N-number of inkjet heads configured to eject ink drops of the ultraviolet curing ink of the N-number of colors, respectively;

a main scan driver configured to drive the N-number of inkjet heads to perform main scan operations of ejecting ink drops while moving in a main scan direction which is predetermined;

a sub scan driver configured to relatively move the N-number of inkjet heads with respect to the medium in a sub scan direction perpendicular to the main scan direction;

temporarily hardening light sources configured to radiate ultraviolet light which hardens the ultraviolet curing ink on the medium to a temporarily hardened state which is a state where at least a surface of the ultraviolet curing ink has adhesiveness;

a fully hardening light source configured to radiate ultraviolet light which completes hardening of the ultraviolet curing ink on the medium; and a pixel selector configured to select pixels onto which ink drops are ejected during each printing pass of the multi-pass mode, wherein the N-number of inkjet heads are installed such that the number of colors of ink dots which are formed in a band area corresponding to each printing pass in each main scan operation becomes smaller than N, whenever a predetermined number of main scan operations are performed on each position on the medium, the temporarily hardening light sources radiate ultraviolet light which hardens the ultraviolet curing ink to the temporarily hardened state, and after main scan operations of all printing passes on each position on the medium finish, the fully hardening light source radiates ultraviolet light, wherein the N-number of inkjet heads include at least:

a first-color head that is an inkjet head configured to eject first-color ink drops which are ink drops of the ultraviolet curing ink of a first color, a second-color head that is an inkjet head configured to eject second-color ink drops which are ink drops of the ultraviolet curing ink of a second color different from the first color, a third-color head that is an inkjet head configured to eject third-color ink drops which are ink drops of the ultraviolet curing ink of a third color different from both of the first color and the second color, and a fourth-color head that is an inkjet head configured to eject fourth-color ink drops which are ink drops of the ultraviolet curing ink of a fourth color different from all of the first color, the second color, and the third color, and the first-color head, the second-color head, the third-color head, and the fourth-color head are installed in this order, side by side in the main scan direction, such that their positions in the sub scan direction are sequentially displaced from each other by a distance which is a product of an integer and a pass width which is a width of one printing pass in the sub scan direction.

11. A printing apparatus which performs printing on a medium with an ultraviolet curing ink of N-number of different colors in an inkjet mode by a multi-pass mode for performing printing on each position on the medium by a plurality of printing passes, wherein N is an integer of 2 or greater, and the printing apparatus comprising:

N-number of inkjet heads configured to eject ink drops of the ultraviolet curing ink of the N-number of colors, respectively;

a main scan driver configured to drive the N-number of inkjet heads to perform main scan operations of ejecting ink drops while moving in a main scan direction which is predetermined;

a sub scan driver configured to relatively move the N-number of inkjet heads with respect to the medium in a sub scan direction perpendicular to the main scan direction;

temporarily hardening light sources configured to radiate ultraviolet light which hardens the ultraviolet curing ink on the medium to a temporarily hardened state which is a state where at least a surface of the ultraviolet curing ink has adhesiveness;

a fully hardening light source configured to radiate ultraviolet light which completes hardening of the ultraviolet curing ink on the medium; and a pixel selector configured to select pixels onto which ink drops are ejected during each printing pass of the multi-pass mode, wherein the N-number of inkjet heads include at least:

a first-color head that is an inkjet head configured to eject first-color ink drops which are ink drops of the ultraviolet curing ink of a first color, and a second-color head that is an inkjet head configured to eject second-color ink drops which are ink drops of the ultraviolet curing ink of a second color different from the first color, whenever a predetermined number of main scan operations are performed on each position on the medium, the temporarily hardening light sources radiate ultraviolet light which hardens the ultraviolet curing ink to the temporarily hardened state, after main scan operations of all printing passes on each position on the medium finish, the fully hardening light source radiates ultraviolet light, and in selection of pixels onto which ink drops are ejected during each printing pass, with respect to spatial frequencies representing intervals between pixels onto which ink drops are ejected and which are included in a band area corresponding to one printing pass, the pixel selector sets spatial frequency of pixels onto which ink drops are ejected by the first-color head and spatial frequency of pixels onto which ink drops are ejected by the second-color head, such that they are different from each other.

* * * * *